US007699553B1

(12) United States Patent
Merzon

(10) Patent No.: US 7,699,553 B1
(45) **Date of Patent: *Apr. 20, 2010**

(54) BINDER AND MULTI-FUNCTION BINDER HOLD DOWN PAGE

(76) Inventor: Adam Merzon, 26 Memory La., Greenwich, CT (US) 06381

( * ) Notice: Subject to any disclaimer, the term of this patent is extended or adjusted under 35 U.S.C. 154(b) by 716 days.

This patent is subject to a terminal disclaimer.

(21) Appl. No.: 10/858,280

(22) Filed: Jun. 1, 2004

Related U.S. Application Data

(63) Continuation-in-part of application No. 10/816,362, filed on Mar. 31, 2004, now Pat. No. 7,661,900.

(51) Int. Cl.
*B42F 13/00* (2006.01)

(52) U.S. Cl. ..... 402/73; 402/70

(58) Field of Classification Search ..... 281/29, 281/15.1; 402/4, 57, 73, 500; D19/26, 27
See application file for complete search history.

(56) References Cited

U.S. PATENT DOCUMENTS

| | | | | | |
|---|---|---|---|---|---|
| 1,121,197 | A | * | 12/1914 | McMillan | 402/31 |
| 1,414,758 | A | * | 5/1922 | Stavenhagen | 402/60 |
| 2,333,523 | A | * | 11/1943 | Cohun | 281/16 |
| 3,837,680 | A | * | 9/1974 | Cimini | 281/16 |
| 4,470,620 | A | * | 9/1984 | Gerch | 281/31 |
| 4,515,493 | A | * | 5/1985 | Radovich | 402/4 |
| 4,575,273 | A | * | 3/1986 | Gerriet | 402/75 |
| 4,676,527 | A | * | 6/1987 | Palmer | 281/31 |
| 4,832,369 | A | * | 5/1989 | Johnson et al. | 281/18 |
| D314,011 | S | * | 1/1991 | Stahl | D19/27 |
| 5,174,674 | A | * | 12/1992 | Norwood | 402/73 |
| 5,215,398 | A | * | 6/1993 | White et al. | 402/73 |
| 5,294,208 | A | * | 3/1994 | Tremmel et al. | 402/70 |
| D364,640 | S | * | 11/1995 | Zimbelman | D19/27 |
| 5,540,512 | A | * | 7/1996 | Pinzauti | 402/79 |
| 5,632,566 | A | * | 5/1997 | Korzilius et al. | 402/79 |
| D399,525 | S | * | 10/1998 | Parker | D19/26 |
| 5,911,441 | A | * | 6/1999 | Yamamoto et al. | 281/15.1 |
| 5,975,576 | A | * | 11/1999 | Vogel | 281/16 |
| 6,439,611 | B1 | * | 8/2002 | Chen | 281/29 |

(Continued)

FOREIGN PATENT DOCUMENTS

DE 4237287 C1 * 10/1993

(Continued)

*Primary Examiner*—Dana Ross
*Assistant Examiner*—Matthew G Katcoff
(74) *Attorney, Agent, or Firm*—Stephen Cannavale, Esq.

(57) ABSTRACT

A binder hold down page of multifunction construction. The hold down page is equipped with at least one article holder. The hold down page has a hold down surface opposite an outer surface, at least one of which is configured with an article holder of integral construction. A plurality of article holders can be provided, each for holding a different type of article. In one preferred embodiment, both surfaces are configured with at least one article holder. In another preferred embodiment, both surfaces are configured with a plurality of article holders. A hold down page constructed in accordance with the invention is retained along one side in a binder. The hold down page preferably also is releasably latched to the binder along a side of the page that is spaced from the side captured by the binder. Rings can be used to retain the hold down page in the binder.

51 Claims, 15 Drawing Sheets

U.S. PATENT DOCUMENTS

| | | | | |
|---|---|---|---|---|
| 6,729,790 | B1 * | 5/2004 | Moor et al. | 402/75 |
| 6,739,784 | B1 * | 5/2004 | Tims et al. | 402/73 |
| 7,137,752 | B2 * | 11/2006 | Hendee | 402/73 |
| 2003/0035681 | A1 * | 2/2003 | Ho | 402/8 |

FOREIGN PATENT DOCUMENTS

| | | | |
|---|---|---|---|
| EP | 206911 | A1 * | 12/1986 |
| EP | 454906 | A1 * | 11/1991 |
| GB | 1168498 | A1 * | 10/1969 |

* cited by examiner

BINDER AND MULTI-FUNCTION BINDER HOLD DOWN PAGE

CROSS REFERENCE TO RELATED APPLICATION

This application is a continuation-in-part of U.S. patent application Ser. No. 10/816,362, filed on Mar. 31, 2004, now U.S. Pat. No. 7,661,900 the entirety of which is incorporated by reference herein.

FIELD OF THE INVENTION

The present invention relates to binders, and more specifically to a binder hold down page of multi-function construction that is equipped with one or more article holders.

BACKGROUND OF THE INVENTION

In the past, binder arrangements consisted of a pair of covers each joined to a spine by a hinge with at least one binder, such as a three ring binder, attached to an inside surface of one of the covers. In previous binder arrangements, the hinge was a conventional hinge that is a separate component that attaches to the spine and one of the covers. Unfortunately, use of a separate hinge is not only more costly to produce, but it also increases assembly costs because it requires more assembly steps. More recently, living hinges formed by a break or weakness in a board of one-piece construction have been used to break the board up into a pair of covers and a spine. However, such a hinge only permits the cover to bend relative to the spine along a single line. Where the storage volume of the binder is at or greater than the storage capacity of the binder, closing the binder becomes more difficult. In fact, repeated closings of an overfilled binder can create a crease elsewhere in one or both binder covers. Over time, such a crease can develop into a crack that leads to premature failure of the binder cover, ultimately requiring replacement of the binder.

Binders often include a hold down page whose function is to help hold down the contents being held by the binder to keep the contents of the binder more organized. Unfortunately, hold down pages typically are themselves not tied down or otherwise anchored, making them largely ineffective. In addition, hold down pages often warp, curl or become bent over time because of this. As a result, hold down pages are often a nuisance and many times are discarded.

Binder arrangements can be packaged in the configuration of a case that can be opened using a zipper that has one end attached to the spine. Unfortunately, over time, repeated openings and closings of the zipper can tear the end of the zipper from the spine or tear the zipper such that the zipper teeth will no longer properly engage thereby making it difficult, if not impossible, to close the case.

Finally, binder arrangements that have a pair of opposed binders often are difficult to close because the rings of one of the binders often interferes against the rings of the other one of the binders. Repeated interference can cause binder rings to bend making it difficult to open and close them. Just as bad, interference between the rings can cause creasing of one or both covers if excessive force is applied, such as what can happen out of frustration, when closing the binder arrangement.

In the past, hold down pages have been solely used to help secure the contents of a binder. Typically, they are provided to help prevent the contents of a binder from warping, twisting or otherwise undesirably shifting relative to the binder and to each other. In fact, binder hold down pages have generally been of such flimsy or poor construction, they end up being ill suited to perform their intended hold down function, let alone do anything else. As such, it is heretofore believed that binder hold down pages have not been configured to do anything else other than serving its intended hold down function. The result is a great deal of wasted binder page surface area.

What is needed is an improved binder arrangement that can be configured as a case that addresses at least one of these problems. What is further needed is a binder arrangement that opens and closes more smoothly, that is more robust, and that lasts longer.

What is also needed is a binder hold down page that function as something else in addition to functioning as a hold down page. What is further needed is a binder hold down page that more efficiently utilizes at least a portion of its surface area.

SUMMARY OF THE INVENTION

The invention is directed to a binder arrangement that can be configured as a case. The binder arrangement has a pair of covers connected to a spine by hinges. The inner surface of one or both covers can be equipped with a binder that has a plurality of rings capable of opening to receive sheets of material and closing to retain the sheets of material.

In one preferred embodiment, the binder arrangement includes a board or panel of one piece, unitary and homogenous construction from which the covers and spine are formed. The board or panel includes a plurality of hinges each of which is located between one of the covers and the spine. Each hinge preferably is formed of a plurality of pairs of scores formed in a surface of the board that preferably is an interior surface. Each score preferably is a slit that extends from adjacent one edge of the board to adjacent the other edge of the board. Each score is a depression formed in a surface of the board that does not extend completely through the board but which weakens the board along the score permitting the board to bend at least somewhat along each score. Collectively, the group of scores forms a hinge that need not bend in an abrupt manner like prior art binder hinges, but rather which bends a little bit along a plurality of scores to impart a radius of curvature to the bend.

In a preferred embodiment, each hinge is formed by a region of scores that also compresses the board in that region and between the scores. In a preferred embodiment, the scored region is formed from between five and twelve scores that are equidistantly spaced apart. Preferably, the scored region has a width of between one half inch and one and one half inches thereby permitting the hinge to more smoothly bend. By providing a wider hinge, the storage volume of the binder is advantageously increased by as much as 40% because the hinge can bend in a plurality of places to accommodate larger storage volumes. In addition, where the binder arrangement has multiple binders, each hinge can better accommodate binder ring clashing because each hinge has more give.

In a preferred embodiment, the binder arrangement is equipped with a pair of generally opposed binders that are offset such that one of the binders does not directly overlies the other one of the binders during closing thereby preventing binder ring clashing. In one preferred embodiment, one binder is offset relative to the other binder such that the one binder is spaced farther away from a centerline of the spine than the other binder.

Each binder can be equipped with a hold down sheet that has an adjustable latch arrangement that is self-adjusting to accommodate varying binder storage volumes. The latch arrangement includes a latch strap that preferably is of flexible construction that engages with a latch receiver. One of the latch strap and latch receiver has a hook strip of a hook and loop fastener arrangement and the other one of the latch strap and latch receiver has a loop strip of a hook and loop fastener arrangement. The latch strap preferably is anchored to one of the binder covers and the latch receiver preferably comprises either a hook strip or a loop strip that is fixed directly to the hold down page.

In one preferred embodiment, the binder arrangement is configured as a case that has sidewalls extending about the outer edges of the binder covers that are releasably joined by a fastening arrangement that permits skirts of the sidewalls to be separated to enable the binder arrangement to be opened or closed. The fastening arrangement preferably is attached to the spine by a stretchable gather that preferably is of elastomeric construction. The case preferably is formed of an outer covering that is fixed to the binder covers and spine that terminates in sidewall skirts that extend outwardly beyond the peripheral edges of the binder covers. A preferred fastening arrangement is a zipper that has one end anchored to the spine by gather such that the gather stretches as needed when the zipper is being opened or closed to reduce tension at the zipper end.

The invention is further directed to a multifunction hold down page for a binder that can be of single, dual or multiple binder construction. The binder has at least one cover for which a multifunction hold down page constructed in accordance with the invention helps hold binder contents against the cover. The hold down page is of multifunction construction as it is preferably equipped with at least one article holder that preferably is integrally formed of the hold down page. The hold down page preferably is releasably latched to the binder cover. This not only helps to more stably secure the binder contents, it also helps minimize hold down page movement, thereby enabling the hold down page to more securely and stably retain an article in its article holder.

The hold down page has a hold down surface that is disposed toward binder contents being releasably retained by the binder. The hold down page has an outer surface that is opposite the hold down surface and which generally faces toward a user of the binder when the binder is opened.

In one preferred embodiment, the outer surface is configured with at least one article holder. In another preferred embodiment, the outer surface is configured with a plurality of article holders, each constructed and arranged to hold a different type of article. In a still further preferred embodiment, the outer surface is configured with a plurality of pairs of article holders.

In one preferred embodiment, the hold down surface is configured with at least one article holder. In another preferred embodiment, the hold down surface is configured with a plurality of article holders. In a still further preferred embodiment, the hold down surface is configured with a plurality of pairs of article holders.

In one preferred embodiment, the outer surface and the hold down surface are each configured with at least one article holder. In another preferred embodiment, the outer surface and the hold down surface are each configured with a plurality of article holders. In a still further preferred embodiment, the outer surface and the hold down surface are each configured with a plurality of pairs of article holders.

One preferred type of article holder is a pocket that overlies the hold down surface or the outer surface to which it is attached. The pocket can be equipped with a reclosable fastening arrangement that preferably is a zipper. The pocket can have a mesh outer sidewall.

Another preferred type of article holder is a notebook or notepad article holder. This type of article holder preferably includes at least one hold down strap that holds down part of the notebook or notepad to releasably retain the notebook or notepad. The strap preferably is of elastomeric construction and can be made of elastic. The notebook or notepad holder can include a pocket in which a backing board of the notebook or notepad is inserted.

A still further type of preferred article holder is a pen or pencil holder. Each pen or pencil holder is formed by a loop that overlies part of the hold down surface or the outer surface to which it is attached. A plurality of such loops can be formed by a single strap that is selectively anchored to the hold down page. The strap preferably is of elastomeric construction such that it can also be made of elastic.

A still another type of preferred article holder is a flat, planar object article holder. This type of article holder is a pocket that includes a slot into which a flat, planar object is inserted to releasably retain it. One preferred flat, planar object article holder is configured to hold a disk-shaped article that preferably is a compact disk, a digital video disk, or the like. Another preferred flat, planar object article holder is configured to hold a card, such as a business card, a digital memory card, or the like.

Such a flat, planar object article holder is particularly well suited for the hold down surface of a hold down page constructed in accordance with the invention as it minimally interferes with the hold down function of the hold down page. In one preferred embodiment, a plurality of pairs of flat, planar object article holders are arranged in an array such that each pocket thereof partially overlaps an adjacent pocket. Such an arrangement is particularly well suited for releasably holding a plurality of pairs of cards, compact disks, or digital video disks.

In another preferred embodiment, the article holder is constructed and arranged to hold the article without allowing it to be withdrawn. Such an article holder can be used, for example, to hold a device, such as a calculator, a screen or display, a personal digital assistant, or the like, without permitting the device to be removed from the hold down page.

One preferred hold down page embodiment includes a pair of outer coverings that are each attached to one side of a base board that is thicker than either one of the outer coverings. Each article holder is formed of or attached to one of the outer coverings and preferably also anchored to the base board. If desired, one or more panels can overlie one or both outer coverings and can be anchored thereto and the base board. A binding strip preferably extends about the outer periphery of the base board to help keep everything together and to help reinforce the hold down page.

A latch arrangement preferably is used to releasably latch the hold down page to its binder. Preferably, the latch arrangement releasably latches the hold down page to part of the binder cover. The latch arrangement includes a latch strap and a latch receiver with one of these components being mounted to the hold down page and the other one of these components being mounted to the binder. One preferred arrangement is a VELCRO closure that has a hook strip attached to one of the hold down page and the binder and a mating loop strip attached to the other one of the hold down page and the binder.

The latch arrangement preferably is located adjacent an outer side edge of the hold down page and is attached or anchored to an adjacent binder cover. The latch arrangement is constructed and arranged to be adjustable so as to be able to accommodate binder contents of varying thicknesses, as well as compensate for any article held by the hold down page, while still being able to releasably latch the hold down page.

A hold down page constructed in accordance with the invention can be used with binder arrangements that have only a single binder. A hold down page constructed in accordance with the invention is also well suited for use with binder arrangements that have a plurality of binders.

One preferred binder arrangement is a dual binder arrangement where each binder has a hold down page equipped with at least one article holder and a releasable and adjustable hold down page latch. Each hold down page preferably is releasably retained along one side edge by a plurality of spaced apart and reclosable binder rings and is releasably retained along its other side edge by the latch.

It is an object of the present invention to provide a hold down page of multifunction construction.

It is an object of the present invention to provide a hold down page that is capable of holding a plurality of different types of articles.

It is another object of the present invention to provide a hold down page that is capable of holding a plurality of different types of articles and that is releasably latchable along a side edge opposite which it is releasably retained in binder rings.

It is an advantage that a hold down page constructed in accordance with the invention can function as an article holder in addition to being a hold down page.

Objects, features and advantages of the invention include one or more of the following: providing a binder arrangement equipped with hinges having a width and contour that permits bending to take place simultaneously at a plurality of locations thereby better accommodating binder ring clash and providing increased binder storage capacity; a binder arrangement that includes binder covers, hinges and a spine formed of a board of economical one-piece, unitary and homogenous construction; a binder arrangement that has hinges which permit bending at a plurality of pairs of locations along the hinge thereby producing a bend having a smooth radius instead of an abrupt transition; a binder arrangement with hinges that make opening and closing easier under a wide variety of binder loading conditions; a binder arrangement having a plurality of generally opposed binders that prevents, if not eliminates, binder ring clashing by offsetting one of the binders relative to the other one of the binders; a binder arrangement that is configured as a case that has a zipper end mounted to the binder arrangement by a resilient and elastomeric shock absorbing arrangement that stretches as needed to take up, transfer and absorb stresses transmitted through the zipper during case opening and closing; a binder arrangement equipped with a hold down page latch arrangement that is positively locking and that is adjustable; and a binder arrangement that is of economical construction, that is robust, that is reliable, that is long-lasting, that is more durable, that is of simple construction, and which is economical to make and use.

Further objects, features and advantages of the invention include one or more of the following: providing a binder hold down page that is of multifunction construction; a binder hold down page that is of stable and secure construction; a binder hold down page that is of economical construction, that is robust, that is reliable, that is long-lasting, that is more durable, that is of simple construction, and which is economical to make, assemble, and use.

Various other features and advantages of the present invention will also be made apparent from the following detailed description and the drawings.

BRIEF DESCRIPTION OF THE DRAWINGS

The drawings illustrate the best mode currently contemplated of practicing the present invention. One or more preferred exemplary embodiments of the invention are illustrated in the accompanying drawings in which like reference numerals represent like parts throughout and in which.

Figure 1:
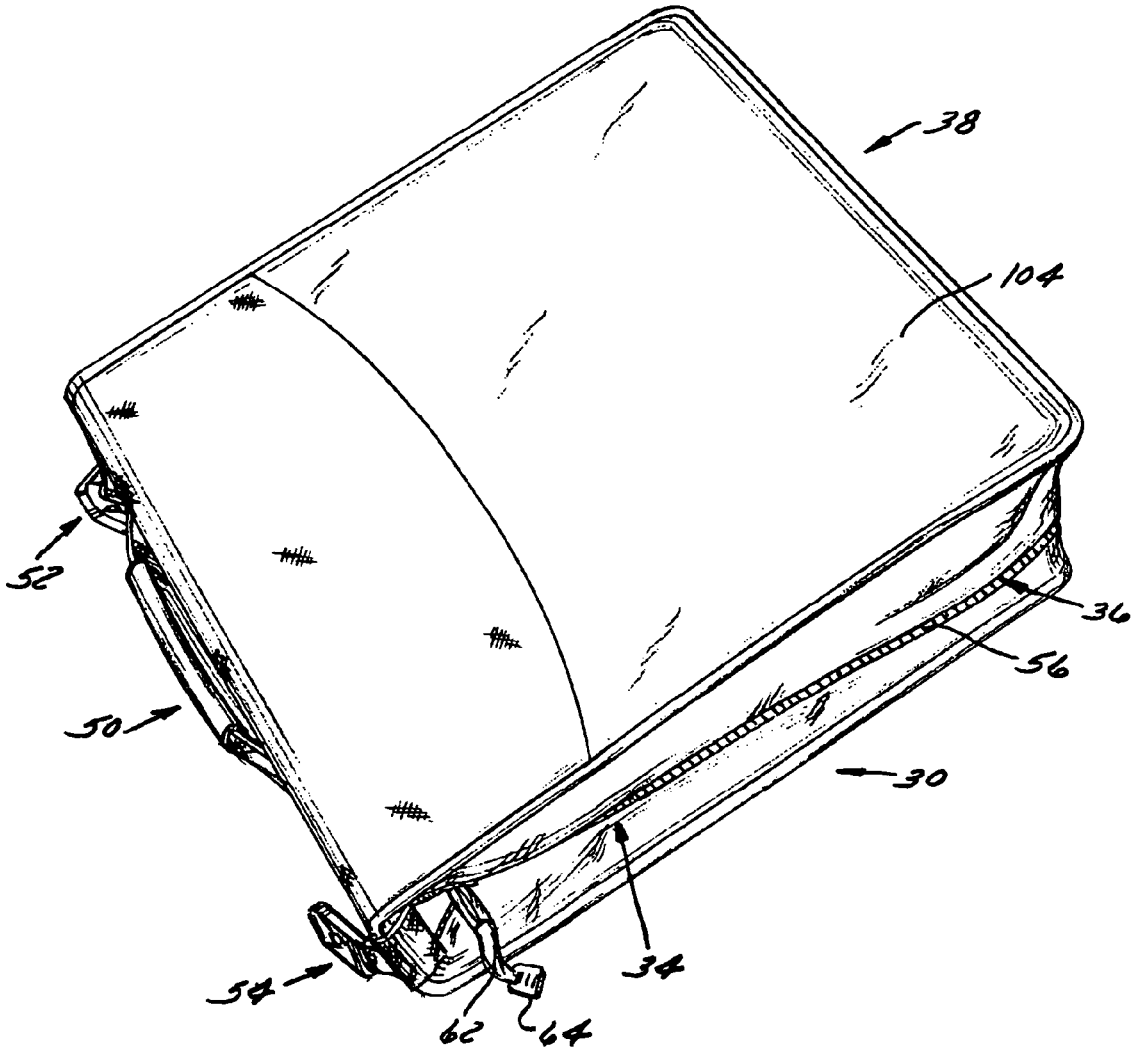
FIG. 1 is a perspective view of a binder arrangement constructed according to the present invention.

Before explaining embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF AT LEAST ONE PREFERRED EMBODIMENT

Figure 2:
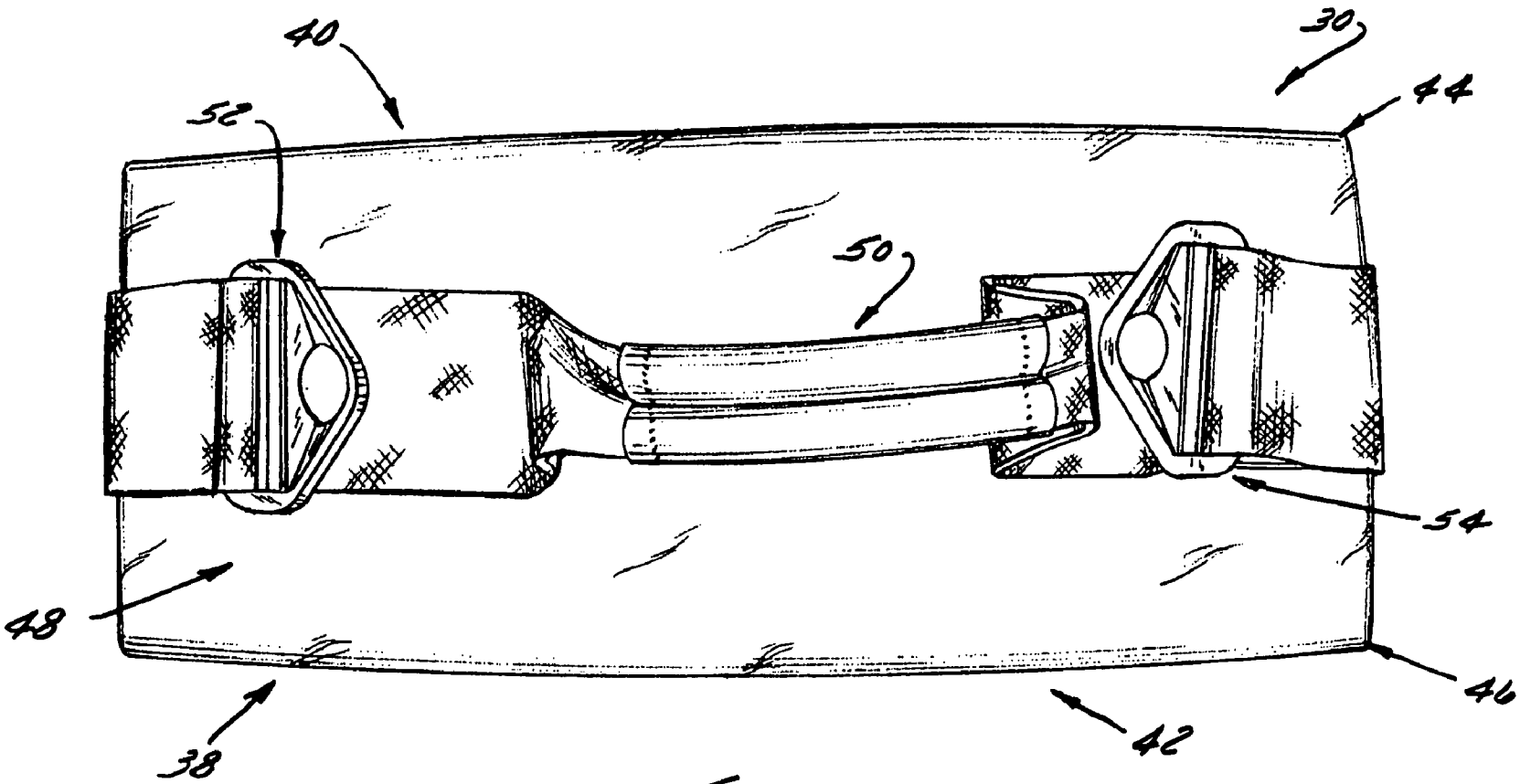
FIG. 2 is an end plan view of the binder arrangement of FIG. 1 in a closed position.
Figure 3:
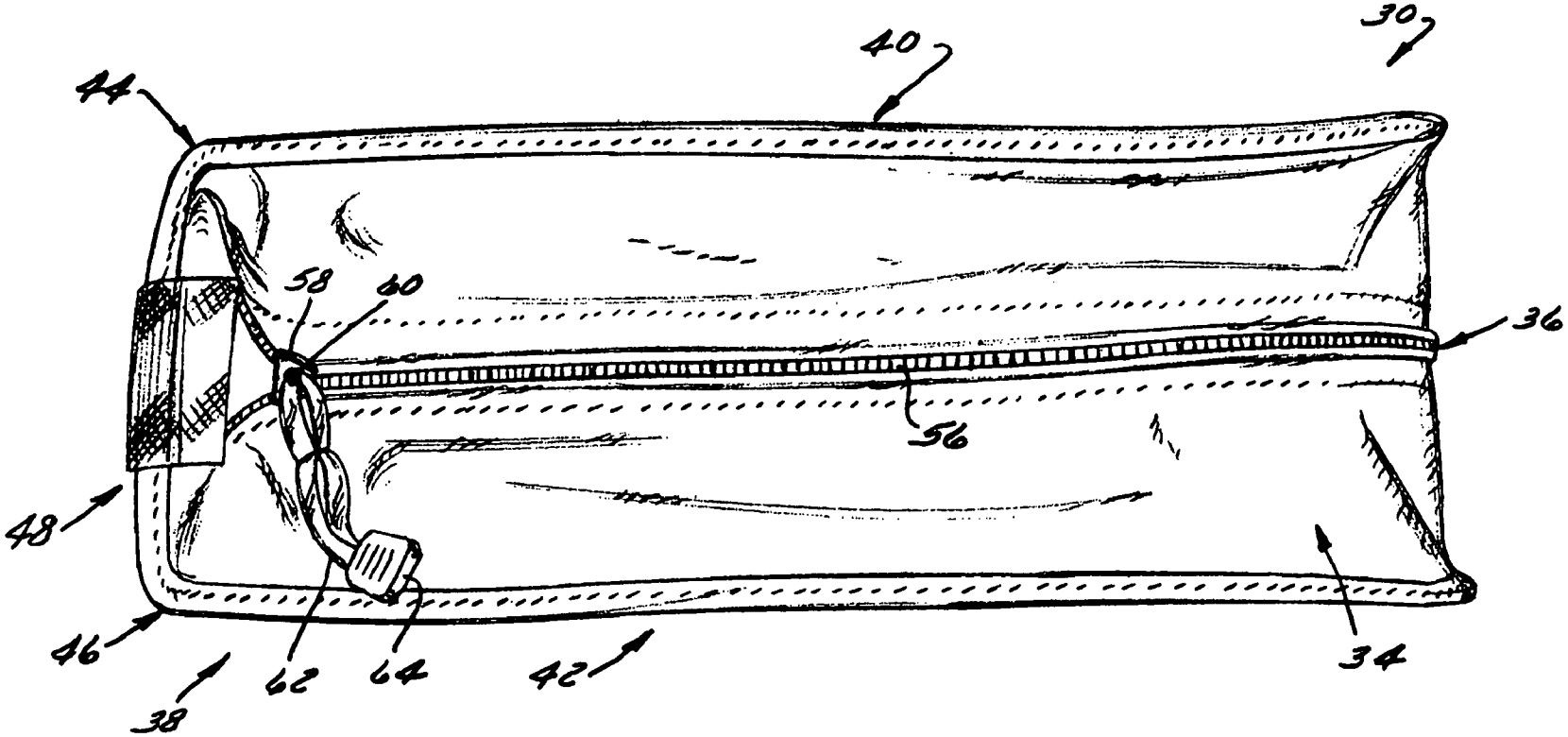
FIG. 3 is a top plan view of the binder arrangement of FIG. 1 in a closed position.

FIGS. 1-4 illustrate a preferred embodiment of a binder arrangement 30 of the invention that preferably includes at least one binder 32 (FIG. 4) and flexible fabric sidewalls 34 that retain the binder arrangement 30 in a closed position via a fastening arrangement 36. When disposed in the closed position with the fastening arrangement engaged, such as is shown in FIGS. 1-3, the binder arrangement 30 preferably forms a case 38 that houses and protects the binder contents.

The binder arrangement 30 has a front cover 40 that overlies a rear cover 42 with the front and rear covers each respectively joined by a hinge 44, 46 to a spine 48 that carries a handle 50 and a pair of strap attachment loops 52, 54. As is shown in FIG. 3, each sidewall 34 is interrupted by and releasably joined together by a fastening arrangement 36 that preferably is a zipper 56 dividing the sidewall 34 into an upper skirt 35 and lower skirt 37. To facilitate opening and closing, a slide 58 of the zipper 56 has a zipper pull tab 60 to which a lanyard 62 is attached. The lanyard 62 preferably includes a handle 64 at its free end that a user can conveniently grasp.

Figure 4:
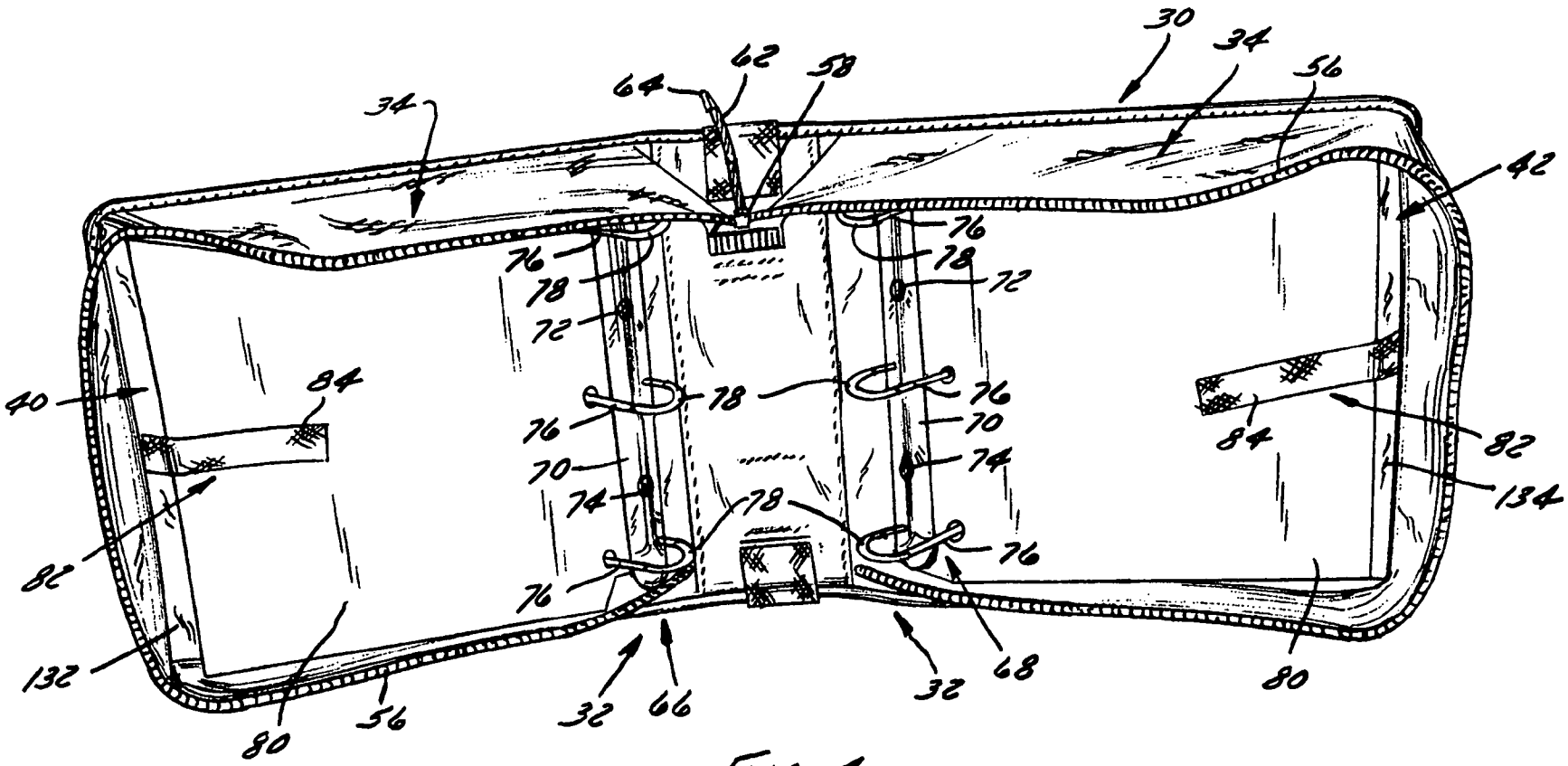
FIG. 4 is a perspective view of the binder arrangement of FIG. 1 in an open position.

FIG. 4 shows the case 38 in an opened position. As is shown in FIG. 4, the case 38 has a plurality of opposed binders, each of which preferably is a three ring binder 66 and 68. Each binder 32 has a mounting post 70 that is attached to one of the covers by a plurality of spaced apart fasteners 72, 74, each of which preferably is a rivet. Each binder 66 and 68 has a plurality of pairs of separable ring halves 76, 78 used to releasably retain pages of material. The binders 66 and 68 are spaced apart by the spine 48, the width of which preferably is selected to permit the case 38 to be closed without the binders 66 and 68 interfering with case closure or each other.

Figure 6:
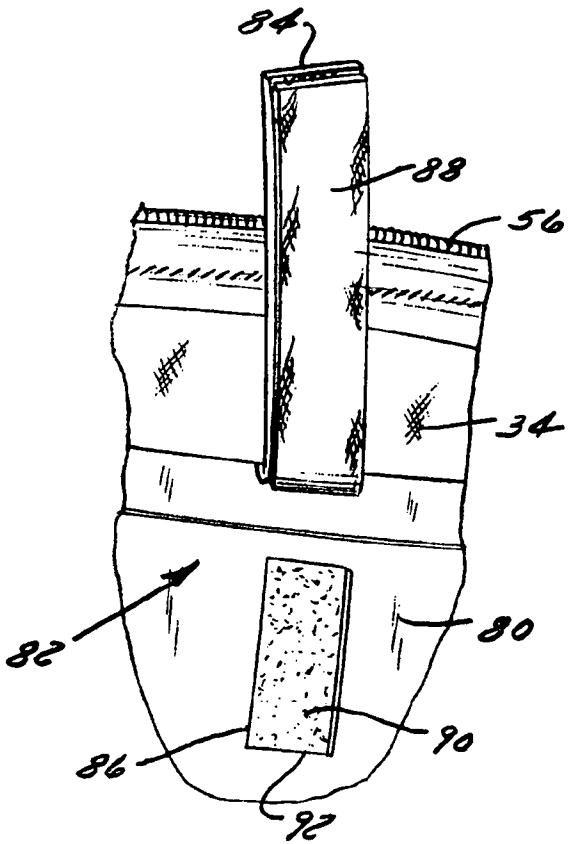
FIG. 6 is a fragmentary top plan view of the hold down page unlatched.
Figure 5:
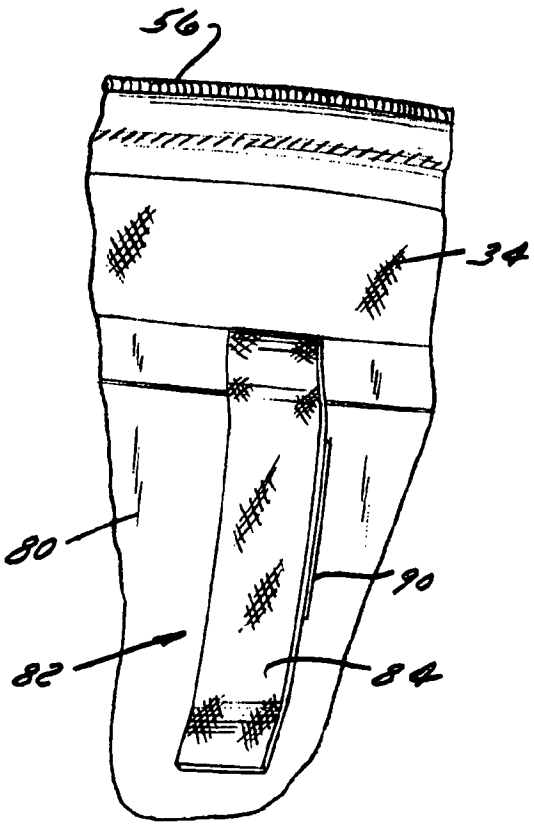
FIG. 5 is a fragmentary top plan view of a portion of the opened binder arrangement showing a hold down page in a latched condition.

As is shown in more detail in FIGS. 5 and 6, each binder 66 and 68 has a hold down page 80 that is used to keep binder contents in place while the case 38 is in use and in transit. Each hold down page 80 is releasably latched in a closed position in FIGS. 4 and 5 by an adjustable latch 82 that includes an anchor strap 84 that is anchored to part of the case 38 and a latch receiver 86 that is attached to the hold down page 80.

In the preferred embodiment shown in the drawing figures, the strap 84 and latch receiver 86 are comprised of a hook and loop fastener arrangement. As is shown in more detail in FIG. 5 with the latch 82 disposed in an unlatched position, the strap 84 is a fabric strap to which a loop strip 88 is attached, and the latch receiver 86 is a hook strip 90 that is attached to the hold down page 80. While a hook and loop fastener tape that is adhesively applied can be used, the loop strip 88 preferably is fixed, such as by stitching or the like, to the latch strap 84, and the hook strip 90 preferably is fixed, such as by stitching or the like, to the hold down page 80.

The length of each strip 88 and 90 is selected so as to ensure positive engagement therebetween for a wide variety of binder thicknesses. For example, in one preferred embodiment, the loop strip 88 extends at least one inch beyond an end 92 of the hook strip 90 and preferably extends as much as two inches beyond the hook strip end 92 when the associated binder is empty. Additionally, the loop strip 88 is at least one and one-half times the length of the hook strip 90 to help ensure maximum engagement between the two strips 88 and 90.

Figure 7:
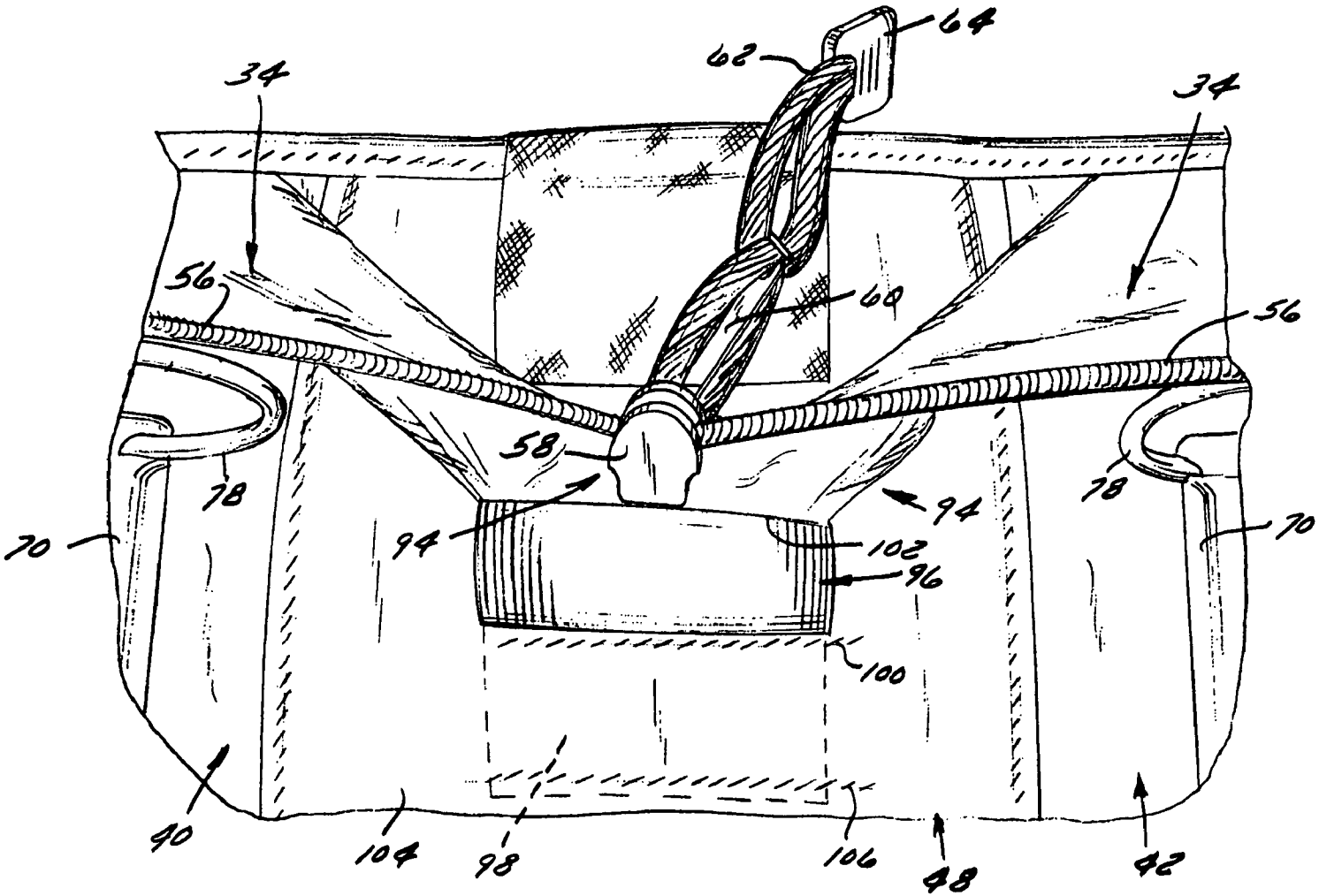
FIG. 7 is a fragmentary top plan view of a portion of the opened case illustrating zipper anchor gather or gusset.
Figure 9:
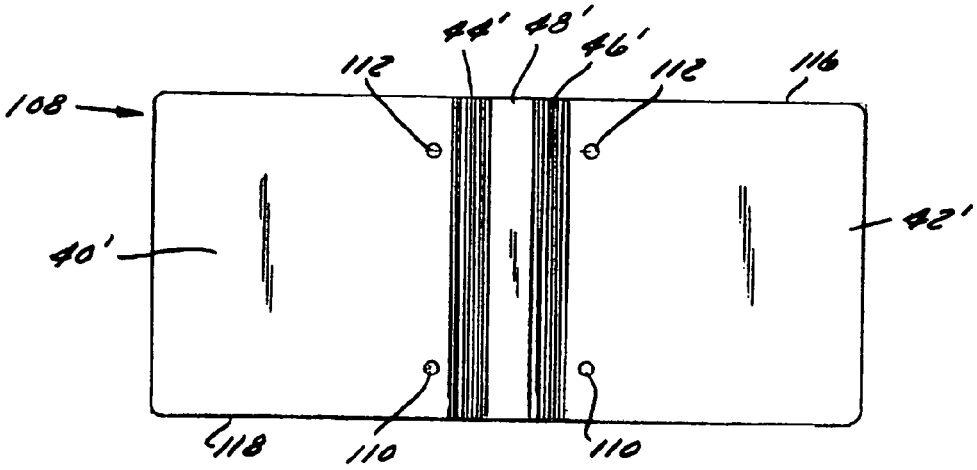
FIG. 9 is a top plan view of the panel with the covers shown in an open position.
Figure 8:
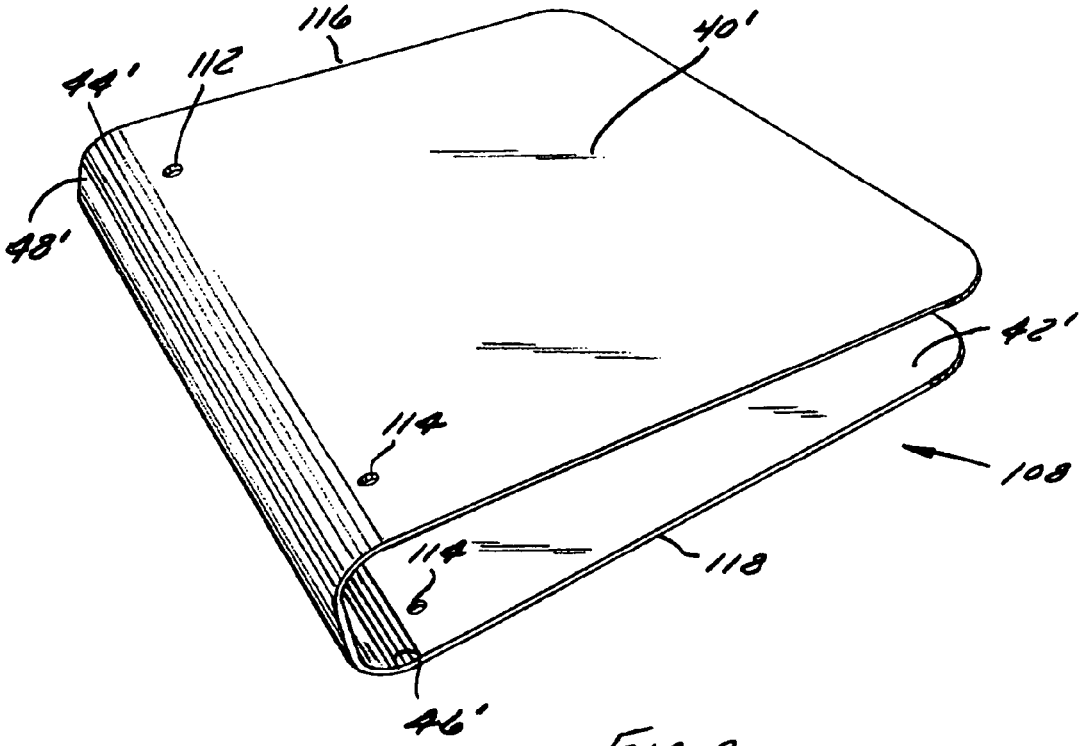
FIG. 8 is a perspective view of a panel that forms the skeleton or base of the binder arrangement that includes a pair of covers each separated from a spine by a hinge that defines a radiused bend and which is capable of bending along a plurality of pairs of locations.
Figure 10:
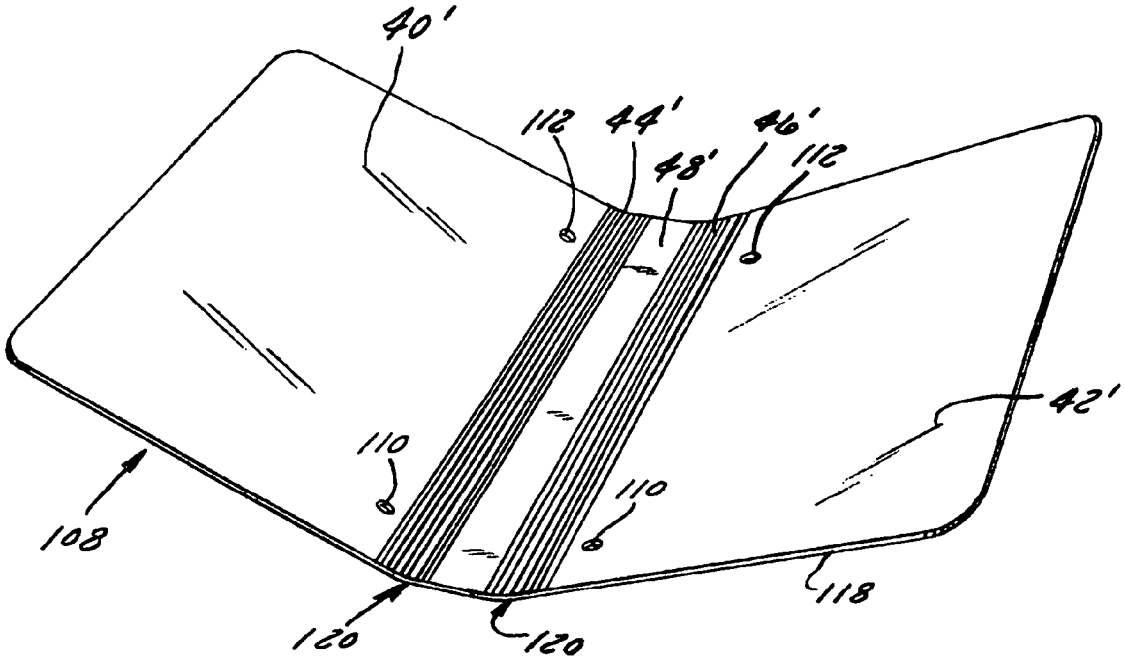
FIG. 10 is a perspective view of the panel with the covers shown in an open position depicting the shape memory imparted to the panel after formation of the hinges.

FIG. 7 illustrates a bottom stop region 94 of the zipper 56 movably anchored to the spine 48 by an elastomeric gather 96 that preferably is made of an elastic band material or of an elastic rubber. A portion 98 of the elastomeric gather 96 adjacent one end of the gather 96 is fixed, preferably via stitching 100, to the spine 48, and the other end 102 of the gather 96 is fixed preferably via stitching (not shown) to fabric in the bottom stop region of the zipper 56. In the preferred embodiment shown in FIG. 7, the anchored portion 98 of the gather 96 underlies an outer covering 104 of the case 38 and is fixed to the spine 48 using a first stitch line 100 and a second stitch line 106 that is spaced from the first stitch line 100.

The stretchable gather 96 flexes to enable the binder arrangement 30, when configured in case form, to be more conveniently used in an open position. In addition, the gather 96 stretches at least slightly to help accommodate opening of the case 38, while preventing the stress and strain of repeated openings and closings from tearing the zipper bottom stop region 94 from the spine 48. As such, the gather 96 acts as a shock absorber to accommodate repeated case openings and closings without tearing free of the spine 48 and without damaging or tearing any portion of the zipper 56.

FIGS. 8-13 illustrate a preferred embodiment of a board 108 used to form an integral binder front cover 40', binder rear cover 42', spine 48' and hinges 44' and 46' that is of one-piece, unitary and homogenous construction. In a preferred embodiment, the board 108 is constructed of a fibrous material, such as, preferably kraftboard or the like. Each cover 40' and 42' has a plurality of spaced apart binder anchors 110 and 112, each of which preferably is a perforation or bore that extends completely through its respective cover.

Figure 11:
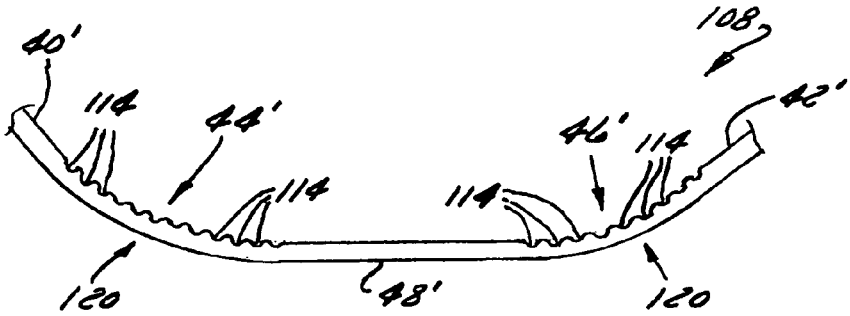
FIG. 11 is an enlarged fragmentary end view of the panel illustrating in more detail each hinge being constructed of a plurality of pairs of scores in an interior surface of the panel.
Figure 12:
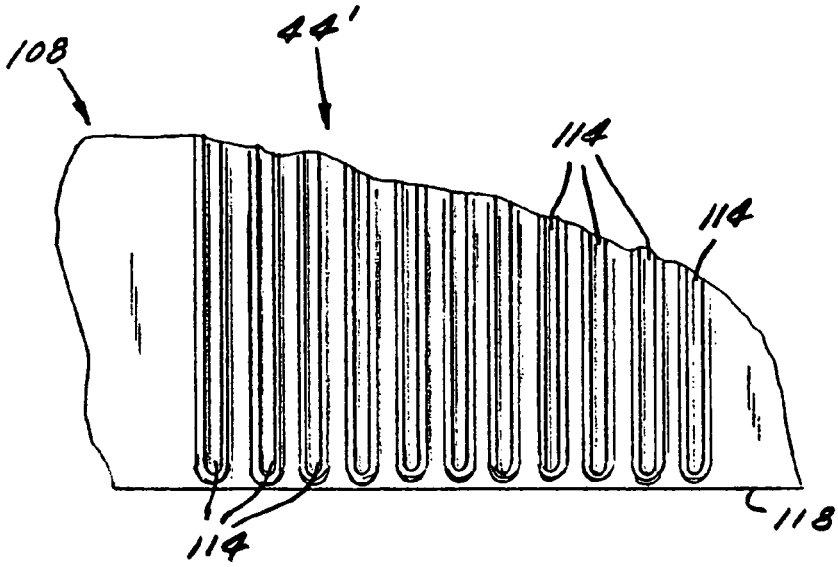
FIG. 12 is an enlarged fragmentary top plan view of another preferred hinge embodiment that is formed by scores that are slits pressed into the surface of the panel.

As is shown in more detail in FIGS. 11 and 12, each hinge 44' and 46' is integrally formed of a plurality of pairs of scores 114 (i.e., at least three) that each extend from adjacent a top side edge 116 of the board 108 to a bottom side edge 118 of the board 108. While each score 114 can be a divot, like that shown in FIG. 11, each score 114 preferably is a slit, like that shown in FIG. 12, that extends to a depth that is greater than one-quarter the thickness of the board 108 and no greater than about one-half the thickness of the board 108. The scores 114 preferably are equidistantly spaced apart. Preferably, the region of each hinge 44' and 46' is scored such that the scored region compresses the material of the board 108 at least one-sixty fourth of an inch such that a shape memory is imparted to each hinge that inherently forms a bend 120 in the board 108 at each hinge. The result is a hinge 44' and 46' that not only permits the front cover 40 and rear cover 42 to bend easily but which also helps form the board 108 into the shape of a binder.

In one preferred embodiment, each hinge 44' and 46' consists of between five and twelve scores 114 and forms a hinge that extends from between one-half inch and one and one-half inches. In a preferred embodiment, each hinge 44' and 46' has at least five scores 114 and an extent of between three quarter of an inch and one and one-quarter inch.

Figure 13:
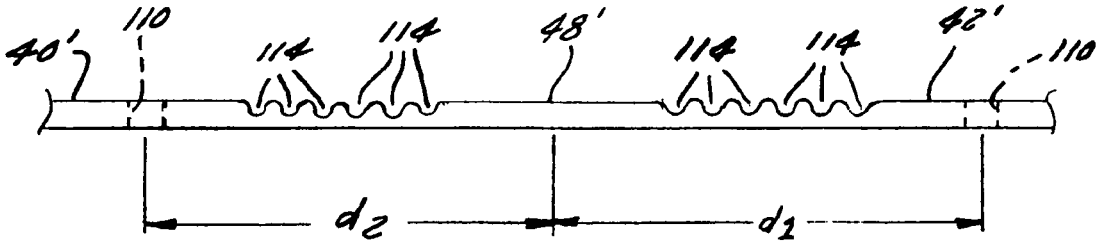
FIG. 13 is an enlarged fragmentary end view of the panel depicting offsetting of binder anchors punched in the panel so as to offset the binder attached to one cover relative to the binder attached to the other cover such that binder ring clashing preferably is prevented.

FIG. 13 illustrates another preferred aspect of the invention where the binder anchors 110 and 112 of one cover 42' are spaced farther away from a centerline 122 of the spine 48' than the binder anchors 110 and 112 of the other cover 40'. In the preferred embodiment shown in FIG. 13, the distance, $d_1$, between anchors 110 and 112 of cover 42' is greater than the distance, $d_2$, between anchors 110 and 112 of cover 40'. In one preferred embodiment, $d_1$ is between one-quarter inch and three-quarters of an inch greater than $d_2$ such that one binder 66 is offset relative to the other binder 68 a like amount. In one preferred embodiment, the offset is about one-half inch such that the difference between $d_1$ and $d_2$ is about one-half inch. As a result of this offset, where the binder arrangement 30 is a dual opposed binder arrangement, the binders 66 and 68 do not directly overlie one another when the binder arrangement 30 is closed. Such an offset advantageously facilitates closing the binder arrangement 30 without the binders 66 and 68 interfering with each other or closure of the binder arrangement.

In use, a binder arrangement 30 of the invention is well suited for holding articles that include paper, media, photos, as well as other things. In a preferred embodiment, such as that shown in drawing FIGS. 1-7, the binder arrangement 30 is configured as a case 38 that preferably includes flexible sidewalls 34 releasably joined by a fastening arrangement 36. If desired, the binder arrangement 30 can be configured so it is not a case such that it lacks sidewalls 34 and fastening arrangement 36.

In operation, where the binder arrangement 30 is configured as a case 38, the case 38 can be closed such as in the manner shown in FIGS. 1-3. When the case 38 is disposed in a closed position, the case 38 can be grasped by its handle 50 and conveniently carried like a suitcase. If desired, a detachable shoulder strap (not shown) can be attached to the strap loops 52 and 54, enabling the case 38 to be carried like a shoulder bag or the like.

Referring to FIG. 3, the case 38 can be opened by grasping the zipper lanyard 62 and pulling the zipper slide 58 in a direction away from one end of the spine 48 of the binder arrangement 30. To fully open the case 38, the zipper slide 58 is pulled in a direction that causes each pair of opposed zipper teeth of the zipper 56 to disengage. The zipper slide 58 is pulled in this manner about the periphery of the case 38 until it stops adjacent the other end of the spine 48.

The case 38 is opened by grasping both covers 40 and 42 and pulling one away from the other until both covers 40 and 42 and the spine 48 are aligned in the manner depicted in FIG. 4. When the case 38 is nearly completely open, the sidewalls 34 of the case 38 that lie along the side of the case 38 where the zipper slide 58 resides become taught, thereby creating tension at the joint created where the zipper teeth meet in the zipper bottom stop region 94. This tension is at least partially dissipated or relieved by the stretchable gather 96 used to anchor the zipper bottom stop region 94 to the spine 48. As a result, the tension actually present where the zipper teeth meet in the zipper bottom stop region 94 is greatly reduced because at least a portion of it is transferred to and absorbed by the gather 96. By the gather 96 providing stress or tension relief in this manner, tearing in the zipper bottom stop region 94 is prevented, which thereby also prevents zipper failure. In addition, by using a stretchable gather 96 to attach the zipper bottom stop region 94 to the spine 48, it functions as a shock absorber that prevents the zipper bottom stop region 94 from tearing free of the spine 48.

To access the contents of one of the binders 66 or 68, the hold down page 80 of that binder is unlatched and the hold down page 80 is pulled upwardly so it rotates on the ring halves 76 and 78 toward the spine 48. To unlatch the hold down page 80, the latch strap 84 is grasped and pulled away from the hold down page 80 until the loop strip 88 disengages from the hook strip 90. When fully disengaged, the hold down page 80 can be manipulated in the manner previously discussed to expose and permit access to the binder contents underneath.

Where the binder arrangement has two or more binders, such as binder arrangement 30 that is equipped with binders 66 and 68, any pair of binders 66 and 68 that would overlie one another when the binder arrangement is closed is offset such that the binders 66 and 68 do not directly overlie one another when the binder arrangement 30 is closed.

To help compensate for any loss of binder storage volume that may occur because of the offset, the binder arrangement 30 preferably is equipped with hinges 44 and 46 of the type depicted in FIGS. 8-13. By equipping the binder arrangement 30 with at least one such hinge and preferably a pair of such hinges, binder storage volume is increased because the relatively wide width of each hinge 44 and 46 permits the hinge to change where it bends. As a result, its bending point automatically changes to accommodate whatever the binder storage volume is. As a result, a binder arrangement 30 equipped with a pair of such hinges 44 and 46 of the invention can accommodate as much as 40% greater binder storage volume than a binder arrangement equipped with conventional hinges.

In a preferred method of manufacture, a press is used that is equipped with a die that includes a base in which the board 108 is located and held. The die includes an upper half that has ridged scorers that are pressed against the board 108 to form the scores 114 that define each one of the hinges 44 and 46. The upper half of the die preferably also is equipped with punches that form each binder anchor 110 and 112 simultaneously with the scores 114.

In a preferred embodiment, the binder arrangement 30 includes an integral case 38 that is equipped with a covering that can be, for example, ballistic nylon or the like. To help increase durability, the covering overlies both sides of each cover 40 and 42 and the spine 48. The covering preferably is attached to a board 108, such as by stitching, an adhesive, fasteners, or a combination thereof. A band is attached to the spine 48 and carries the handle 50 and both strap loops 52 and 54 while preferably reinforcing the spine 48. The band preferably is attached to the spine 48 using stitching, an adhesive, fasteners or the like.

Each binder 66 and 68 includes a hold down page 80 that is equipped with a hold down page latch 82 made in accordance with the latch 82 shown in FIGS. 4-6. The case 38 also includes a fastening arrangement 36 that is anchored at one end using a stretchable gather 96, such as the gather 96 shown in FIGS. 4 and 7. Additionally, each opposed pair of binders 66 and 68 are staggered or offset, preferably between one-fourth inch and three-quarters of an inch, to promote ease of closing of the binder arrangement 30. The binder arrangement 30 is formed from a board 108 that includes scored hinges 44 and 46 of the type depicted in FIGS. 8-13.

While a set of binder rings, each defined by a pair of reclosable ring halves 76 and 78, can be mounted to each one of the binder covers 40 and 42, one or more sets of rings can be mounted to the spine 48 in addition to or instead of the two sets of rings depicted in FIGS. 4 and 7. If desired, a binder constructed in accordance with the invention can have a single set of rings mounted to or otherwise carried by the spine 48.

Figure 14:
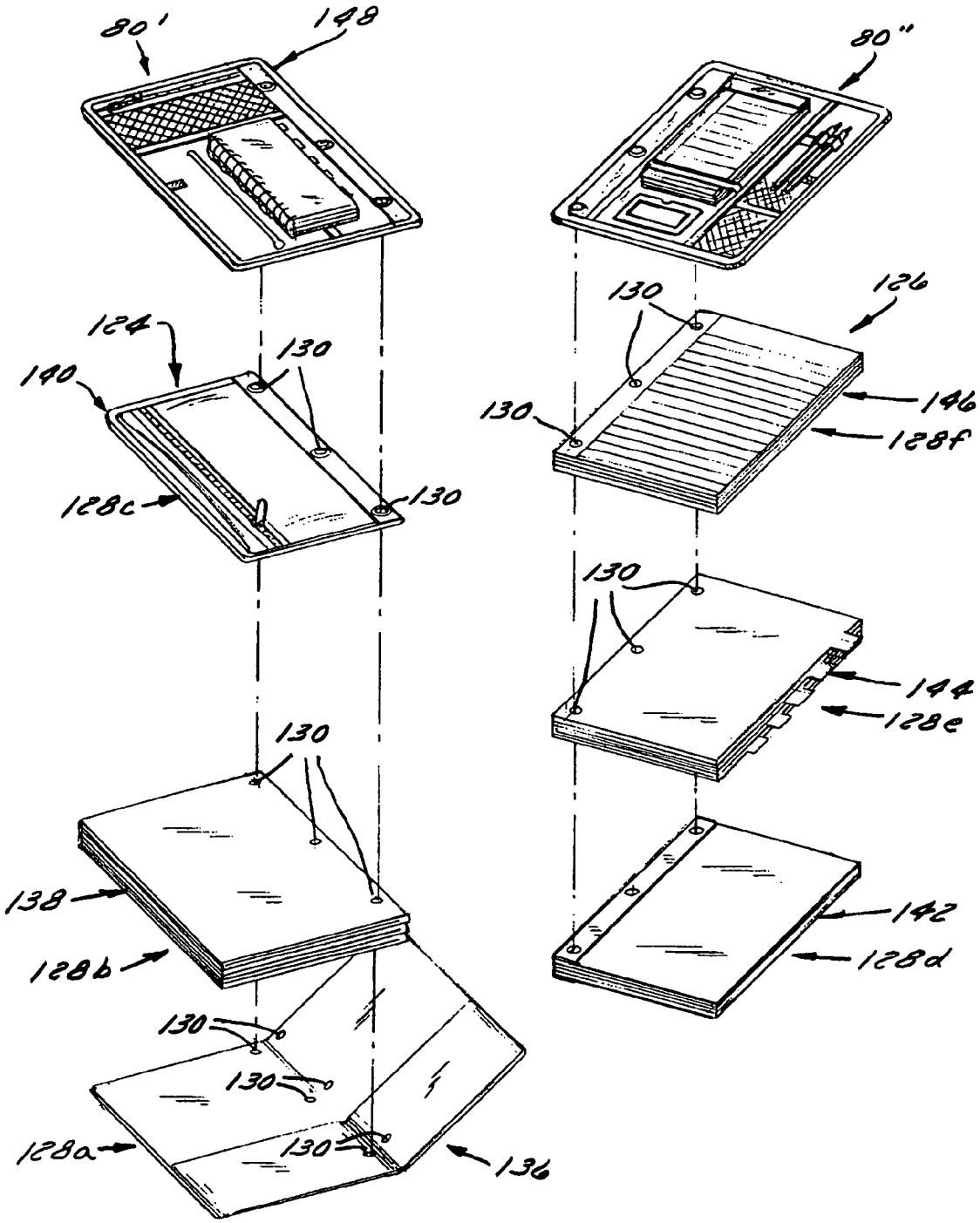
FIG. 14 illustrates one preferred set of contents of a dual binder arrangement.

FIG. 14 illustrates a plurality of sets of binder fillings 124 and 126 with one of the binder fillings being a left hand side binder filling 124 carried by the left hand binder 66 (FIG. 4) and the other one of the binder fillings being a right hand side binder filling 126 carried by the right hand side binder 68. Each binder filling 124 and 126 includes a plurality of fillers 128*a*, 128*b*, 128*c*, 128*d*, 128*e*, and 128*f*, that each have a plurality of holes 130. therethrough with each hole receiving one ring of a binder. An example of such a ring is identified collectively by reference numerals 76 and 78 shown in FIG. 4. Where the binder arrangement employs a plurality of integral binders, such as the dual binder arrangement 30 depicted in FIG. 4, a plurality of sets of binder fillings, such as binder fillings 124 and/or 126, preferably are used. Where the binder arrangement employs a single binder, such as only binder 66 or binder 68, a single binder filling or single binder filler can be used. In a presently preferred implementation, each filler 128*a*, 128*b*, 128*c*, 128*d*, 128*e*, and 128*f* has a plurality of pairs (i.e. at least three) of holes 130 therethrough, each for receiving a single ring of a binder that also has a plurality of pairs of rings.

The fillers of each binder filling 124 and 126 preferably are releasably kept in place by a hold down page, such as hold down page 80' or 80", that preferably is releasably latchable to part of the binder, preferably one of the binder covers, such as binder cover 40 or 42 (FIG. 4), such as in the manner discussed above. As is discussed in more detail below, a hold down page, such as hold down page 80' and/or 80", constructed in accordance with the invention preferably is of multi-function construction. For example, each hold down page 80' and 80" is constructed and arranged to hold a plurality of different types of articles.

When assembled, each filler of each binder filling is located between an adjacent binder cover and a hold down page. For example, in the preferred embodiment depicted in FIG. 14, one or more of fillers 128*a*, 128*b*, and 128*c* of filling 124 are held against an inner surface 132 (FIG. 4) of binder cover 40 by hold down page 80' and one or more of fillers 128*c*, 128*d*, and 128*e* of filling 126 are held against an inner surface 134 (FIG. 4) of binder cover 42 by hold down page 80". Although not shown in the drawing figures, the corresponding inner surface 132 and 134 of each binder cover 40 and 42 can include an integrally formed folder along with one or more article holding pockets that can be of mesh construction.

The left hand side binder filling 124 preferably includes a plurality of fillers 128*a*, 128*b*, and 128*c*. In the preferred embodiment shown in FIG. 14, it includes at least one folio or folder 136 located adjacent or against the left hand side binder cover 40. A filler 128*b* that comprises a plurality of pairs of sheets 138 is disposed next to the folio or folder 136. In the preferred embodiment depicted in FIG. 14, the plurality of pairs of sheets 138 comprises at least one notepad or notebook. The remaining filler 128*c* is a removable article holder 140 that is located between the left hand side hold down page 80' and the sheets 138. In the preferred embodiment depicted in FIG. 14, the article holder 140 preferably is a zippered pouch that has a transparent front side that is particularly well suited for holding pencils, pens, erasers and the like.

The right hand side binder filling 126 includes a filler 128*d* that is a notepad or notebook 142 located adjacent or against the right hand side binder cover 42. A filler 128*e* that includes a plurality of pairs of tabbed dividers 144 is disposed adjacent or against the notepad or notebook 142. Folders or the like can be interlineated between tabbed dividers 144, if desired. Another filler 128*f*, preferably a plurality of pairs of sheets of loose-leaf paper 146, such as filler paper or the like, is located between the right side hold down page 80" and the tabbed dividers 144.

Figure 15:
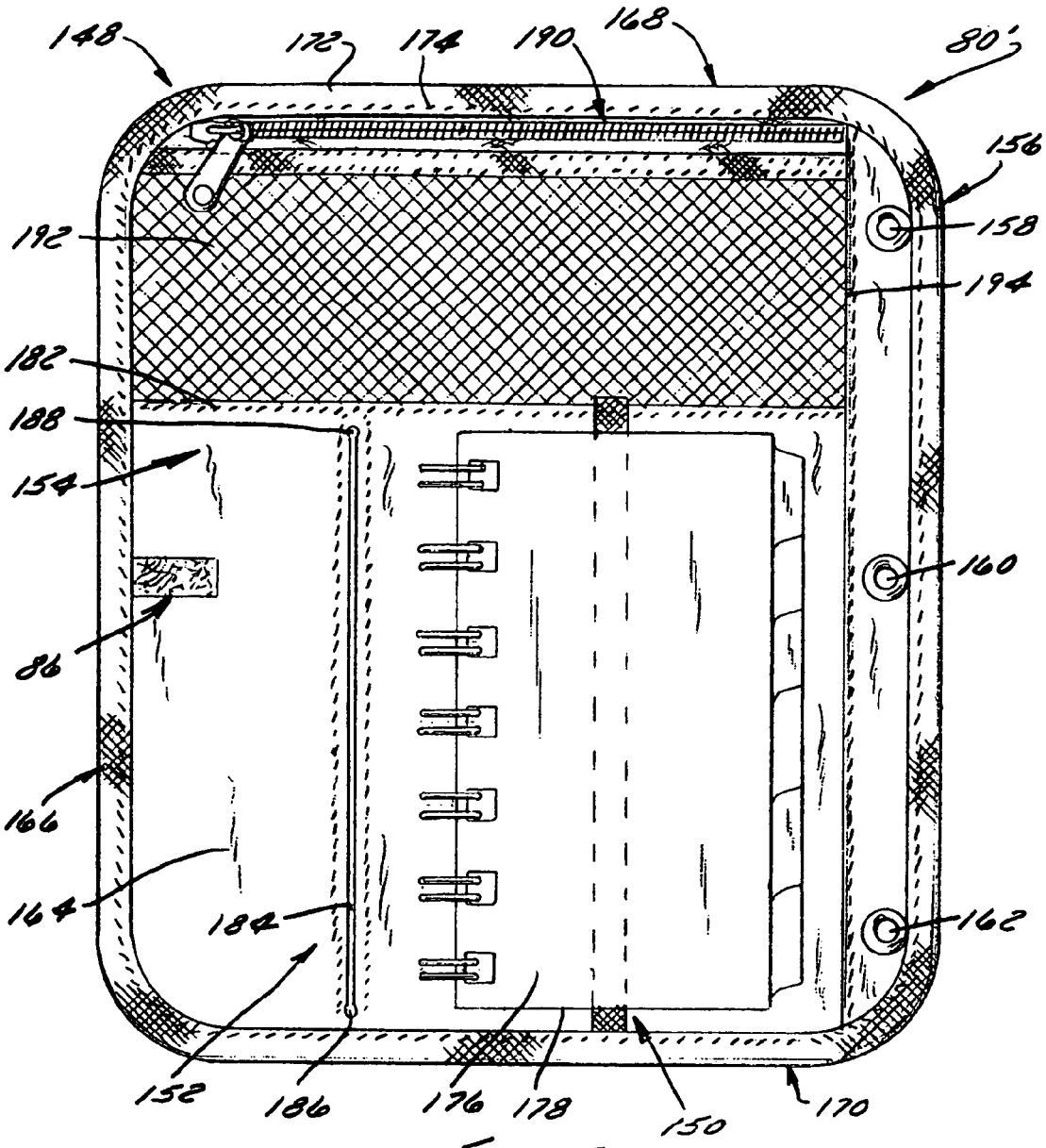
FIG. 15 is a top plan view of one side of a first preferred embodiment of a multi-function hold down page constructed in accordance with the invention.
Figure 16:
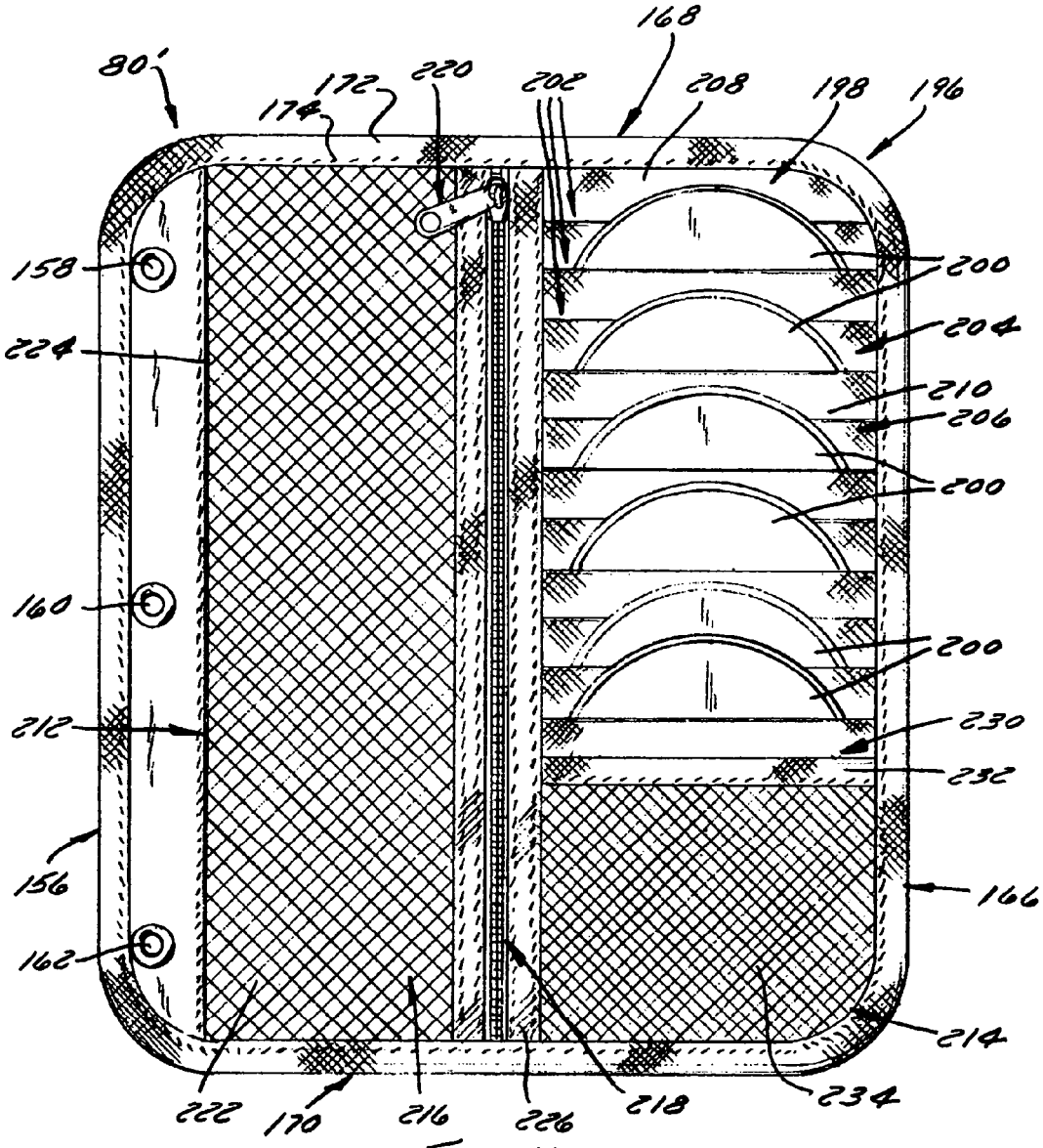
FIG. 16 is a top plan view of an opposite of the second preferred multi-function hold down page embodiment shown in FIG. 15.

FIGS. 15 and 16 illustrate one preferred embodiment of a hold down page 80' constructed in accordance with the invention. In the preferred embodiment shown in FIG. 15, the outer surface 148 of the hold down page 80' is of multi-function construction. The outer surface 148 includes a plurality of spaced apart article holders 150, 152 and 154, each of which preferably is intended to hold a different type of article. The outer surface 148 preferably is configured with a plurality of pairs of article holders 150, 152 and 154.

The hold down page 80' has an inner edge 156 that is disposed adjacent the spine 48 of the binder 66 to which the hold down page 80' is assembled. The hold down page 80' has a plurality of through holes 158, 160 and 162 adjacent the inner edge 156, each of which receives a ring of the binder 66 so it is releasably retained in the binder 66. The outside surface 148 preferably includes an outer covering 164 that extends between the inner and outer side edges 156 and 166 and the top and bottom edges 168 and 170 of the hold down page 80'. The outer covering 164 provides an anchoring surface for each article holder 152, 154 and 156 and preferably forms an integral part of each article holder 152, 154 and 156.

In the preferred embodiment shown in FIG. 15, there is a binding strip 172, preferably welting or the like, that extends along each edge 156, 166, 168 and 170 such that it encompasses the outer periphery of the hold down page 80'. The binding strip 172 is fixed to the hold down page 80', preferably by stitching 174, about the periphery of the page 80'. The binding strip 172 reinforces the hold down page 80' and helps fix the outer covering 164 to the page 90'. The binding strip 172 thus helps to support the article holders 150, 152, and 154, as well as any article held by one or more of the article holders 150, 152 and 154. While the hold down page 80' can have a different shape, it preferably is generally rectangular.

The hold down page 80' preferably is releasably latchable to part of the binder 66; preferably one of the binder covers 40. As such, the hold down page 80' shown in FIG. 15 preferably includes a latch receiver 86 of a latch that preferably is a hook and loop fastener closure 82 that is the same as or like that shown in FIGS. 4-6. Such a latch 82 preferably is of adjustable construction so as to permit the binder 66 to hold material(s) of varying thicknesses while enabling the hold down page 80' to retain them in a stable and secure manner.

One of the article holders 150 is located adjacent the ring holes 158, 160 and 162, and is designed to releasably retain a notebook 176 against the outer surface 148. The notebook holder 150 includes a flat 178 against which a rear cover of the notebook 176 is disposed. The notebook holder 150 includes a hold down strap 180 that is oriented so it extends lengthwise relative to the notebook 176 it is intended to retain. The strap 180 preferably is a band of elastic material that is anchored to the hold down page 80' adjacent each one of its ends. The strap 180 preferably is anchored at or adjacent each end by fixing it to the hold down page 80', such as preferably by stitching or the like. In a presently preferred embodiment, one strap end is anchored by the stitching 174 used to attach the binding strip 172 to the hold down page 80' and the other strap end is anchored by stitching 182 used to attach article holder 154 to the page 80'. In use, the notebook 176 is retained by the strap 180 by manipulating the notepad 176 so the strap 180 is received somewhere between the covers of the notepad or notebook 176.

The notebook 176 shown in FIG. 15 is a spiral bound notebook 176 that has a plurality of pairs of sheets of paper disposed between an outer cover and an inner cover. The particular notebook 176 shown in FIG. 15 has a plurality pairs of tabs that extend outwardly beyond each cover. While a hold down page 80' constructed in accordance with the invention can be equipped with a notebook holder 150 that is well suited for holding such a spiral bound notebook, it can also be configured to hold one or more other types of notepads and notebooks as well.

The outer surface 148 of the hold down page 80' includes a second article holder 152 that is a pocket formed by a vertically extending elongate slot 184 in the outer covering 164 that preferably is generally parallel to the notebook hold down strap 180. The slot 184 preferably is of keyhole construction such that each end 186 and 188 is enlarged and rounded. Such an arrangement is advantageous as it prevents the outer covering 164 from tearing along either slot end 186 or 188. In use, an article (not shown) that preferably is of flat or planar construction is inserted at least partially into the slot 184 to retain it between an interior surface (not shown) of the outer covering 164 and the hold down page 80'. Such a pocket 152 is well suited for use in holding an envelope, one or more sheets of paper, a card, cardstock, a smart card, a memory stick, an electronic media card, or some other flat and planar article.

The outer surface 148 of the hold down page 80' preferably also includes a third article holder 154 that is a pocket that has an opening that can be opened and closed using a reclosable fastening arrangement that preferably is a zipper 190. The pocket 154 is formed of mesh 192 that is fixed along its periphery to the hold down page 80', preferably by stitching, including stitching 182 and 194. The mesh 192 preferably is constructed of nylon or another synthetic material that is flexible, stretchable, durable and strong. In the hold down page outer surface 148 shown in FIG. 15, the mesh pocket 154 is disposed adjacent the top edge 168 of the hold down page 80'.

Referring to FIG. 16, the hold down page 80' preferably also has a hold down surface 196 that also is of multi-function construction. The hold down surface 196 is an inner surface of the hold down page 80' that is located on the side of the page 80' that is opposite the outer surface 148 shown in FIG. 15.

The hold down surface 196 preferably includes at least one article holding arrangement 198. The article holding arrangement 198 is disposed adjacent the outer edge 166 of the hold down page 80'. The article holding arrangement 198 is constructed and arranged to hold at least one flat, planar article 200. Such a flat, planar article holding arrangement 198 advantageously permits the hold down surface 196 of the hold down page 80' to hold one or more flat, planar articles 200 without interfering with the hold down function of the page 80'.

The article holding arrangement 198 preferably comprises a plurality of pairs of article holders 202 arranged in an array such that each article holder 202 is disposed parallel to one another. Each flat, planar article holding article holder 202 preferably is a pocket 204 that includes a flap 206 that is integrally formed of an outer covering 208 that overlies the hold down surface 196 of the hold down page 80'. The flap 206 is defined by a transversely extending slot 210 through which at least one flat, planar article 200 is inserted into the pocket 204.

The article holding arrangement 198 shown in FIG. 16 has a plurality of pairs of article holders 202 of this construction longitudinally arrayed and identical to one another. Preferably, the article holding arrangement 198 has at least four article holders 202. The preferred embodiment shown in FIG. 16 has eleven article holders 202 each arranged such that a plurality of pairs of article holders 202 partially overlap one another such that part of an article 200 received in one article holder 202 partially overlaps an article 200 received in an immediately adjacent article holder 202.

As is shown in FIG. 16, six flat, substantially planar articles 200 are each received in their own flat, planar article holding pocket 204. Each article holding pocket 204 preferably is constructed and arranged to hold media that can be computer readable. A preferred type of article 200 which each pocket 204 is well suited to hold is a compact disk, such as a CD-ROM disk, a DVD-ROM disk, or the like.

The hold down surface 196 of page 80' preferably also includes a plurality of article holders 212 and 214 that are each constructed and arranged to hold an article different from each other and from the articles 200 held by the article holders 202 of the flat, planar article holding arrangement 198.

Article holder 212 is disposed adjacent the inner edge 156 of the hold down page 80'. The article holder 212 is a pocket 216 that has an opening 218 that can be opened or closed using a reclosable fastening arrangement 220 that preferably is a zipper. The opening 218, and hence the zipper 220, extends in a longitudinal direction substantially the length of the page 80'. The pocket 216 preferably is formed by an outer wall 222 that preferably is made of a flexible and elastomeric mesh. The periphery of the mesh outer wall 222 is fixed to the hold down page 80', preferably by stitching 224 and 174 and welting strip 226.

Disposed adjacent the outer and the bottom edges 166 and 170 of the hold down page 80' is a third article holder 214 that preferably is a mesh pocket 228 that has a generally transversely extending opening 230 formed by a transversely extending flap 232. Its mesh outer sidewall 234 is fixed to the hold down page 80' about its periphery opposite the pocket opening 230, preferably by stitching 174 and welting strip 226.

Figure 17:
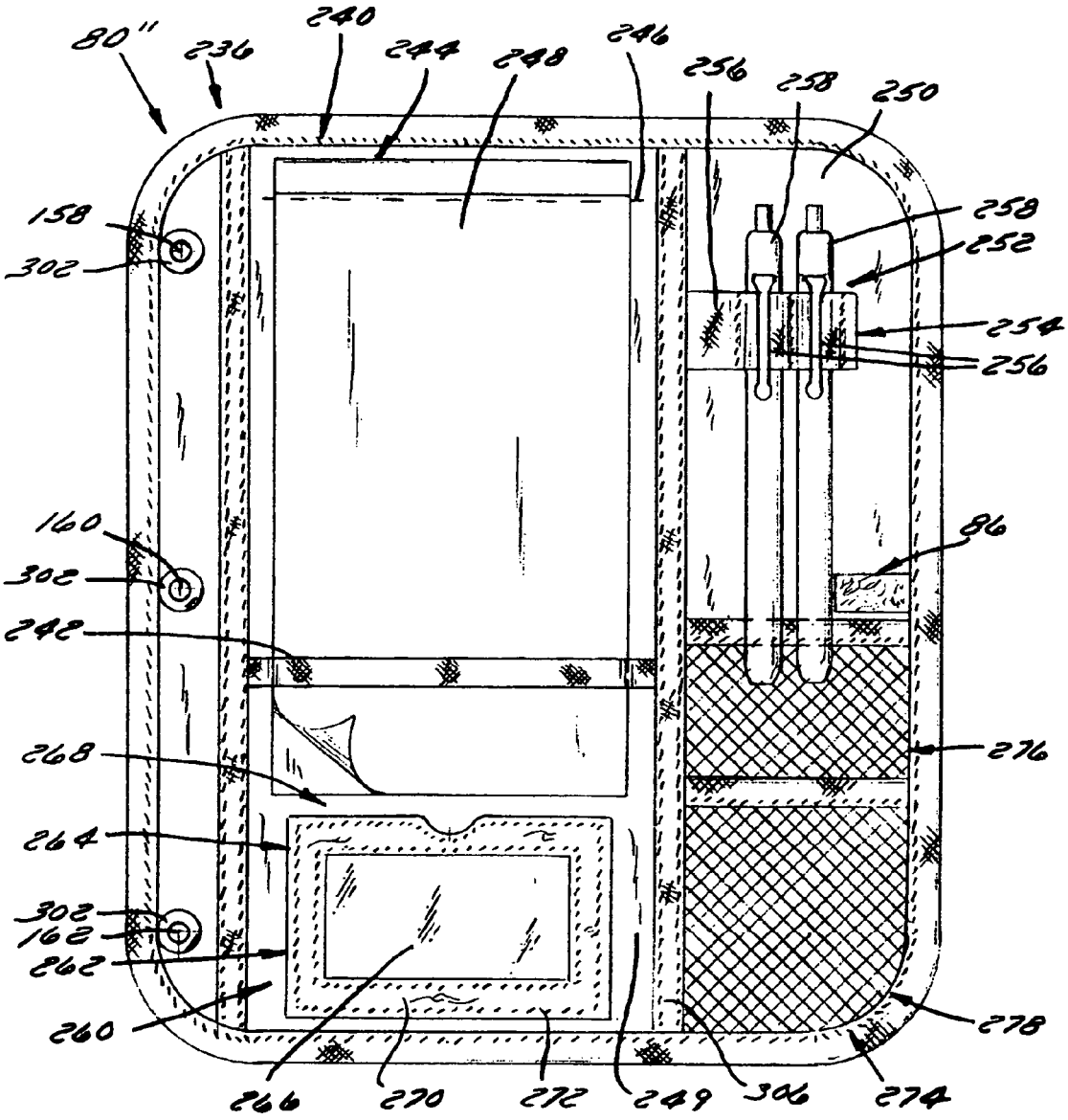
FIG. 17 is a top plan view of one side of a second preferred embodiment of a multi-function hold down page constructed in accordance with the invention.
Figure 18:
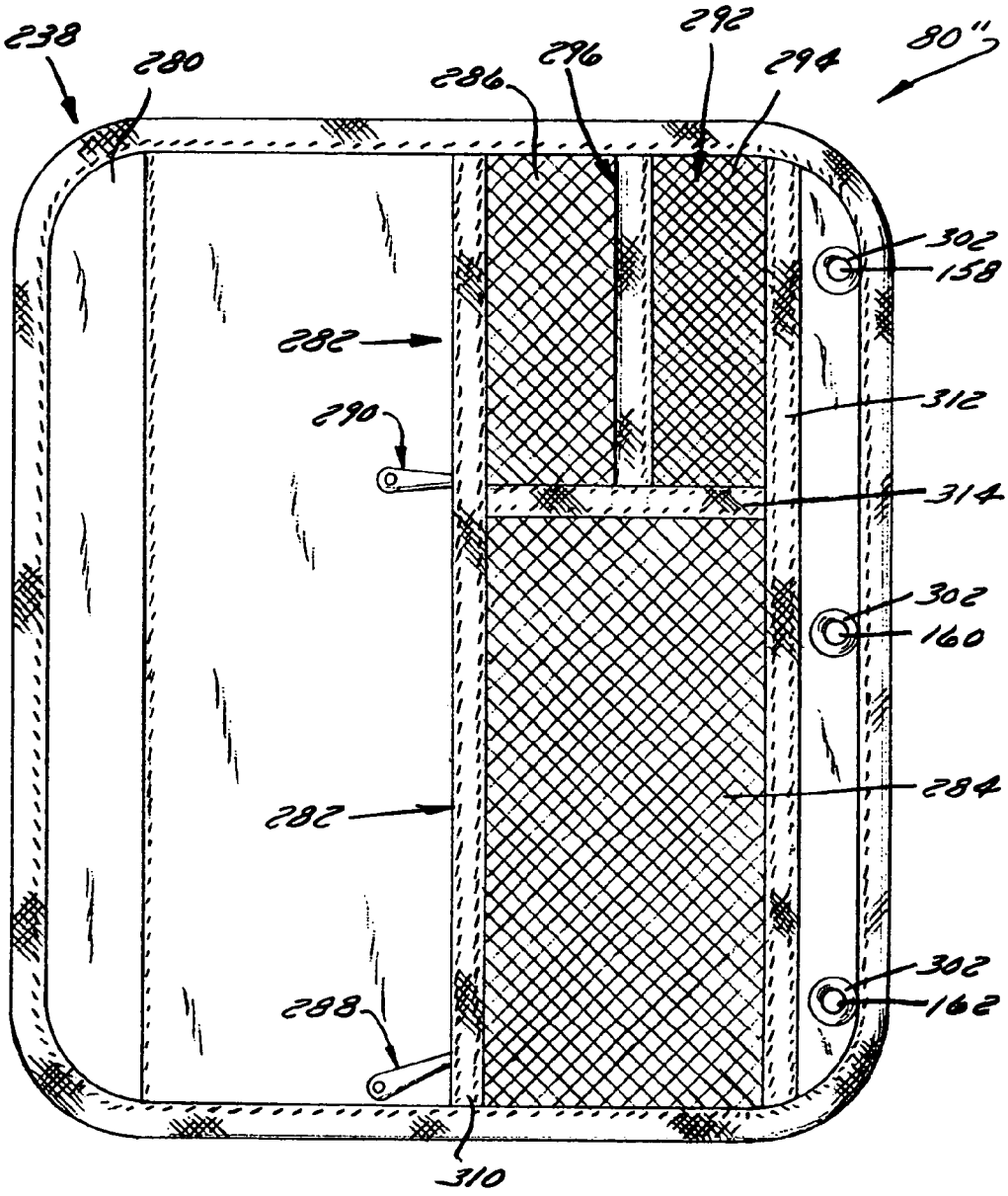
FIG. 18 is a top plan view of an opposite of the preferred multi-function hold down page embodiment shown in FIG. 17.

FIGS. 17 and 18 illustrate another preferred embodiment of a hold down page 80" constructed in accordance with the invention. Hold down page 80" is constructed similarly to hold down page 80', except it has different article holders and article holders arranged differently.

FIG. 17 depicts an outer surface 236 of the hold down page 80" and FIG. 18 depicts a hold down surface 238 of the page 80". At least the outer surface 236 of the hold down page 80" is equipped with a plurality of article holders. In the preferred hold down page embodiment depicted in FIGS. 17 and 18, the outer surface 236 and the hold down surface 238 both preferably include a plurality of article holders, each of which preferably is configured to hold a different type of article.

With specific reference to FIG. 17, the outer surface 236 includes a first article holder 240 that is a notepad holder. The notepad holder 240 has a transversely extending elastic notepad anchor strap 242 used to help retain part of a notepad 244 against a flat section of the outer surface 236. The notepad holder 242 also includes a transversely extending slot 246 that receives a stiff and thicker backing board (not shown) of the notepad 244. When inserted, the backing board is received and releasably retained between the page 80" and a panel 249 that can be part of or overlies an outer covering 250 of the page 80", preferably by stitching or the like. The strap 242 and slot 246 is oriented to position the notepad 244 with its writing surface 248 facing a user opening the binder.

The outer surface 236 includes a second article holder 252 that is a pen or pencil holder. The outer surface 236 preferably includes a plurality of pairs of pencil holders 252, each formed from a single transversely extending elastic strap 254 that is fixed to the hold down page 80" at a plurality of spaced apart locations to form loops 256 of the strap 254 therebetween. A pencil, pen or another cylindrical elongate object 258 can be inserted into and releasably retained by each loop 256. For example, two such objects 258 are each releasably retained side-by-side by one of the loops 256.

The outer surface 236 preferably also includes a third article holder 260 that is a card holder that is a pocket 262 with an exterior wall 264 that is equipped with a transparent window 266 to enable a card within the holder 260 to be viewed through the window 266. The pocket 262 has an opening 268 that extends transversely above the top edge of the window 266. The exterior wall 264 defines a margin 270 about the window 266 that is fixed about its periphery to the hold down page opposite its opening 268, preferably by stitching 272 or the like.

Such an article holder 260 preferably is particularly well suited for holding one or more business cards (not shown). If desired, the article holder 260 can be adapted to hold a digital media card, a calculator, a personal digital assistant, or the like. Depending upon the type of card-like article being held, it may not be necessary to include window 266. Where access to the card-like article is required while it is being retained in the article holder 260, the pocket 262 is configured without any window 266.

The outer surface 236 preferably also includes a fourth article holder 274 that preferably is a mesh pocket. Preferably, there is a plurality of mesh pockets 276 and 278 with one pocket 276 disposed above the other pocket 278. As is more clearly shown in FIG. 19, pocket 278 overlies pocket 276 such that pocket 278 extends underneath pocket 276.

Turning now to FIG. 18, the hold down surface 238 has an outer covering 280 and preferably also includes a plurality of article holders 282, each of which preferably is a mesh pocket 284 and 286 that includes a reclosable fastening arrangement 288 and 290, each of which preferably is a zipper. One of the mesh pockets 284 is larger than the other mesh pocket 286. The hold down surface 238 further includes another article holder 292 that is a mesh pocket 294 that has an opening 296 that always remains open and accessible.

In another preferred embodiment, the article holder is constructed and arranged to hold the article without allowing it to be withdrawn. Such an article holder can be used, for example, to hold a device, such as a calculator, a personal digital assistant, or the like, without permitting the device to be removed from the hold down page.

Figure 19:
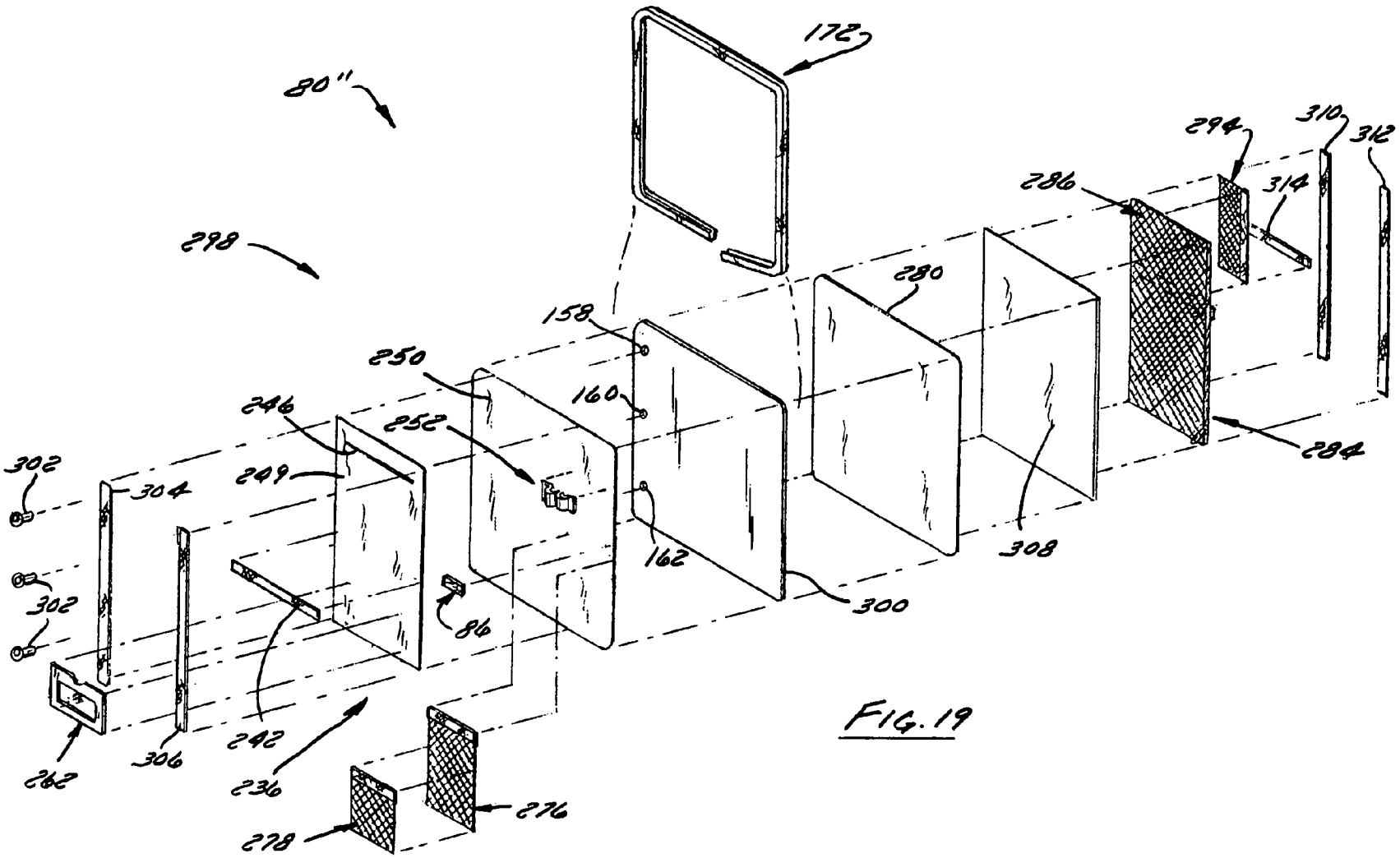
FIG. 19 is an exploded view of the multi-function hold down page depicted in FIGS. 17 and 18.

FIG. 19 illustrates a preferred embodiment of an article holding hold down page assembly 298 of hold down page 80". The hold down page 80" has a base board 300 that is made of plastic, such as polyethylene or the like, of pressed fibrous matter, such as fiber board, Kraft board, or the like, or another sheet material that is thicker than either one of the outer coverings 250 and 280. The base board 300 serves as a backbone of the hold down page to provide it with strength, stiffness, durability, and structural rigidity sufficient not only to function as a hold down page, but also as an article holding hold down page. Preferably, the base board 300 has a thickness of at least about 50 mils (0.05 inch) and no more than about 150 mils (0.15 inch) to help ensure that the base board 300 is stiff enough and strong enough to function as both a hold down page and as an article holder without being too bulky.

The base board 300 serves as the backbone of the hold down page 80". Each one of the article holders of the hold down page 80" is fixed to the base board 300, such as by stitching, heat sealing, adhesive bonding, or the like. For example, in the preferred hold down page embodiment shown in FIGS. 17 and 18, each one of the article holders 240, 252, 260, 274, 282, and 292 of hold down page 80" is at least partially anchored to the base board 300, preferably by being stitched to the base board 300. In addition, the latch receiver 86 is also attached to the base board 300, preferably by stitching.

The base board 300 has a plurality of ring receiving through-holes 158, 160 and 162 formed therein, preferably by being punched. To help strengthen the base board 300 in the region of each through-hole 158, 160 and 162, each through-hole preferably is reinforced by a grommet 302.

Outer covering 250 preferably is attached to the base board 300, such as by being adhesively bonded, heat sealed, stitched or the like. The outer covering 250 preferably is made of a flexible, resilient and durable material, such as nylon, leather, or another material that can be a fabric or the like. In one preferred embodiment, the outer covering 250 is attached to the base board 300 along substantially its entire surface area of contact therebetween. In another preferred embodiment, the outer covering 250 is selectively attached to the base board 300 by stitching.

Panel 249 preferably is separate from the outer covering 250 and is fixed to the base board 300 by a plurality of spaced apart and longitudinally extending welting strips 304 and 306. The panel 249 also preferably is made of a flexible, resilient and durable material, such as nylon, leather, or another material that can be a fabric or the like. Each welting strip 304 and 306 is stitched directly to the base board 300 to secure the panel 249 to the base board 300 in a manner that permits a backing board of a notepad 244 to be inserted through slot 246 behind the panel 249.

Outer covering 280 preferably is attached to the base board 300 in a manner the same as or like that of covering 250. A panel 308 preferably overlies at least part of the outer covering 280. The panel 308 preferably underlies the mesh that forms pockets 284 and 286 and is secured to the base board 300 by a pair of spaced part and longitudinally extending welting strips 310 and 312. The mesh that defines pockets 284 and 286 is anchored to the base board 300 by a transversely extending welting strip 314.

The entire assembly 298 preferably is bounded by a binding strip 172, that is similar to or the same as the binding strip 172 of the hold down page 80' shown in FIGS. 15 and 16. The binding strip 172 preferably is of one-piece construction and is made of a fabric, nylon, leather, or another material. The binding strip 172 overlies all of the edges of the hold down page 80" and overlaps a portion of each outer covering 250 and 280 and part of the base board 300. The binding strip 172 preferably is anchored to the outer coverings 250 and 280 and the base board 300. The binding strip 172 preferably is stitched through both outer coverings 250 and 280 and the base board 300.

An article holding hold down page, such as hold down page 80' or 80", constructed in accordance with the invention has a plurality of spaced apart ring-receiving through holes 158, 160 and 162, with one of the holes 158 being disposed adjacent a top of the page and the other one of the holes 162 being disposed adjacent a bottom of the page. An article holding hold down page, such as hold down page 80' or 80", constructed in accordance with the invention is also releasably latched to part of the binder; preferably one of the binder covers 40 or 42. When releasably latched, an article holding hold down page, such as hold down page 80' or 80" constructed in accordance with the invention not only securely helps hold down binder contents, but is also securely and stably retained in its binder. Its stable and secure retention enables a hold down page 80' and/or 80" made in accordance with the invention to be able to hold articles, preferably a plurality of different types of articles.

It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

It is claimed:

1. A binder arrangement comprising:

a) a pair of binder covers pivotable about a single spine into an opposed orientation; each of said pair of binder covers attached to said single spine by a variable pivot hinge, wherein said binder covers may close into an opposed orientation along a variable pivot axis;

b) wherein said pair of covers and spine are defined by a board that includes a pair of spaced apart integrally formed hinges with each hinge being comprised of a plurality of pairs of scores formed in an interior surface of said board, and wherein each score comprises a slit formed in the interior surface of said board that does not extend completely through said board, and wherein said scores of each hinge define a region of said board that is compressed to a thickness that is less than the surrounding thickness of said board;

c) a plurality of opposed binders, each hingably carried a predetermined distance from a centerline of a spine wherein said centerline is located at the midpoint between a first and second side edge and wherein said plurality of binders are located closer to said centerline than to either of said first or second side edge and attached to said binder covers where the opposed binders are offset from on another by a predetermined distance, and d) a hold down page of multifunction construction.

2. The binder arrangement of claim 1 further comprising a hold down page latch that releasably latches the multifunction hold down page to one of the binder covers.

3. The binder arrangement of claim 2 wherein the latch comprises a latch strap that is carried by one of the binder covers and the multifunction hold down page and a latch receiver that is carried by the other one of the covers and the multifunction hold down page.

4. The binder arrangement of claim 3 wherein one of the latch strap and latch receiver comprises a loop strip of a hook and loop fastener and the other one of the latch strap and latch receiver comprises a hook strip of a hook and loop fastener.

5. The binder arrangement of claim 4 wherein the latch strap comprises a strip of fabric to which one of the loop strip and hook strip is fixed and the latch receiver comprises the other one of the loop strip and hook strip and is fixed to the hold down page.

6. The binder arrangement of claim 1 wherein the multifunction hold down page has a hold down surface and an outer surface opposite the hold down surface, and further comprising an article holder carried by the multifunction hold down page and disposed on the outer surface of the multifunction hold down page.

7. The binder arrangement of claim 6 wherein the article holder is integrally formed of the multifunction hold down page.

8. The binder arrangement of claim 6 wherein the article holder comprises a pocket for releasably holding an article therein.

9. The binder arrangement of claim 8 wherein the pocket is integrally formed of the multifunction hold down page.

10. The binder arrangement of claim 6 wherein the binder further comprises:

a) a plurality of binder rings, each of which is received through a hole in the multifunction hold down page adjacent one side edge of the multifunction hold down page; and;

b) a latch disposed adjacent the other side edge of the multifunction hold down page that releasably latches the multifunction hold down page in place.

11. The binder arrangement of claim 10 wherein the latch releasably engages the outer surface of the multifunction hold down page.

12. The binder arrangement of claim 11 wherein the latch comprises a latch strap that is carried by one of the binder covers and the multifunction hold down page and a latch receiver that is carried by the other one of the covers and the multifunction hold down page.

13. The binder arrangement of claim 12 wherein one of the latch strap and latch receiver comprises a loop strip of a hook and loop fastener and the other one of the latch strap and latch receiver comprises a hook strip of a hook and loop fastener.

14. The binder arrangement of claim 13 wherein the latch strap comprises a strip of fabric to which one of the loop strip and hook strip is fixed and the latch receiver comprises the other one of the loop strip and hook strip and is fixed to the hold down page.

15. The binder arrangement of claim 6 wherein the article holder comprises a notebook or notepad holder.

16. The binder arrangement of claim 6 wherein the article holder comprises a mesh pocket.

17. The binder arrangement of claim 6 wherein the article holder comprises an integrally formed folder.

18. The binder arrangement of claim 6 wherein the article holder comprises a pen or pencil holder.

19. The binder arrangement of claim 6 wherein the article holder comprises a card holder.

20. The binder arrangement of claim 1 wherein the multifunction hold down page has a hold down surface disposed toward binder contents secured by the multifunction hold down page and an outer surface opposite the hold down surface, and further comprising an article holder carried by the multifunction hold down page and disposed on the hold down surface of the multifunction hold down page.

21. The binder arrangement of claim 20 wherein the article holder is integrally formed of the multifunction hold down page.

22. The binder arrangement of claim 21 wherein the article holder comprises a pocket for releasably holding an article therein.

23. The binder arrangement of claim 22 wherein the pocket is integrally formed of the multifunction hold down page.

24. The binder arrangement of claim 20 wherein the binder further comprises:

a) a plurality of binder rings, each of which is received through a hole in the multifunction hold down page adjacent one side edge of the multifunction hold down page; and b) a latch disposed adjacent the other side edge of the multifunction hold down page that releasably latches the multifunction hold down page in place.

25. The binder arrangement of claim 24 wherein the latch releasably engages the outer surface of the multifunction hold down page.

26. The binder arrangement of claim 25 wherein the latch comprises a latch strap that is carried by one of the binder covers and the multifunction hold down page and a latch receiver that is carried by the other one of the covers and the multifunction hold down page.

27. The binder arrangement of claim 26 wherein one of the latch strap and latch receiver comprises a loop strip of a hook and loop fastener and the other one of the latch strap and latch receiver comprises a hook strip of a hook and loop fastener.

28. The binder arrangement of claim 20 wherein the article holder comprises a flat, planar article holder.

29. The binder arrangement of claim 28 wherein the flat, planar article holder is constructed and arranged to hold a plurality of compact disks or digital video disks.

30. The binder arrangement of claim 20 wherein the article holder comprises a mesh pocket.

31. The binder arrangement of claim 20 wherein there are a plurality of article holders each constructed and arranged to hold a different type of article.

32. The binder arrangement of claim 1 wherein the multifunction hold down page has a hold down surface and an outer surface opposite the hold down surface, and further comprising a first article holder carried by the multifunction hold down page and disposed on the outer surface of the multifunction hold down page and a second article holder carried by the multifunction hold down page and disposed on the hold down surface of the multifunction hold down page.

33. The binder arrangement of claim 32 wherein each article holder is integrally formed of the multifunction hold down page.

34. The binder arrangement of claim 33 wherein each article holder comprises a pocket for releasably holding an article therein.

35. The binder arrangement of claim 34 wherein the pocket is integrally formed of the multifunction hold down page.

36. The binder arrangement of claim 32 wherein the binder further comprises:

a) a plurality of binder rings, each of which is received through a hole in the multifunction hold down page adjacent one side edge of the multifunction hold down page; and b) a latch disposed adjacent the other side edge of the multifunction hold down page that releasably latches the multifunction hold down page in place.

37. The binder arrangement of claim 36 wherein the latch releasably engages the outer surface of the multifunction hold down page.

38. The binder arrangement of claim 37 wherein the latch comprises a latch strap that is carried by one of the binder covers and the multifunction hold down page and a latch receiver that is carried by the other one of the covers and the multifunction hold down page.

39. The binder arrangement of claim 38 wherein one of the latch strap and latch receiver comprises a loop strip of a hook and loop fastener and the other one of the latch strap and latch receiver comprises a hook strip of a hook and loop fastener.

40. The binder arrangement of claim 32 wherein the hold down surface comprises a plurality of article holders each constructed and arranged to hold a different type of article and the outer surface comprises a plurality of article holders each constructed and arranged to hold a different type of article.

41. A binder arrangement comprising:

a) a pair of binder covers pivotable about a single spine into an opposed orientation;

b) each of said pair of binder covers attached to said single spine by a variable pivot hinge, wherein said binder covers may close into an opposed orientation along a variable pivot axis;

c) wherein said pair of covers and spine are defined by a board that includes a pair of spaced apart integrally formed hinges with each hinge being comprised of a plurality of pairs of scores formed in an interior surface of said board, and wherein each score comprises a slit formed in the interior surface of said board that does not extend completely through said board, and wherein said scores of each hinge define a region of said board that is compressed to a thickness that is less than the surrounding thickness of said board;

d) a plurality of binder rings each hingably carried a predetermined distance from a centerline of a spine wherein said centerline is located at the midpoint between a first and second side edge and wherein said plurality of binder rings are located closer to said centerline than to either of said first or second side edge and attached to said binder covers where said plurality of binder rings are offset from on another by a predetermined distance;

e) a hold down page releasably retained by the binder rings, the hold down page having a hold down surface and an outer surface opposite the hold down surface that is configured with an article holder; and f) a latch that releasably secures the hold down page to one of the binder covers.

42. A binder arrangement comprising:

a) a pair of binder covers pivotable about a single spine into an opposed orientation;

b) each of said pair of binder covers attached to said single spine by a variable pivot hinge, wherein said binder covers may close into an opposed orientation along a variable pivot axis;

c) wherein said pair of covers and spine are defined by a board that includes a pair of spaced apart integrally formed hinges with each hinge being comprised of a plurality of pairs of scores formed in an interior surface of said board, and wherein each score comprises a slit formed in the interior surface of said board that does not extend completely through said board, and wherein said scores of each hinge define a region of said board that is compressed to a thickness that is less than the surrounding thickness of said board;

d) a plurality of binder rings each hingably carried a predetermined distance from a centerline of a spine wherein said centerline is located at the midpoint between a first and second side edge and wherein said plurality of binder rings are located closer to said centerline than to either of said first or second side edge and attached to said binder covers where said plurality of binder rings are offset from on another by a predetermined distance;

e) a hold down page releasably retained by the binder rings, the hold down page having a hold down surface that is configured with a first article holder and an outer surface opposite the hold down surface that is configured with a second article holder.

43. The binder arrangement of claim 42 further comprising a hook and loop closure that releasably latches the hold down page to one of the binder covers.

44. A binder arrangement comprising:

a) a pair of binder covers pivotable about a single spine into an opposed orientation;

b) each of said pair of binder covers attached to said single spine by a variable pivot hinge, wherein said binder covers may close into an opposed orientation along a variable pivot axis;

c) wherein said pair of covers and spine are defined by a board that includes a pair of spaced apart integrally formed hinges with each hinge being comprised of a plurality of pairs of scores formed in an interior surface of said board, and wherein each score comprises a slit formed in the interior surface of said board that does not extend completely through said board, and wherein said scores of each hinge define a region of said board that is compressed to a thickness that is less than the surrounding thickness of said board;

d) a plurality of binder rings each hingably carried a predetermined distance from a centerline of a spine wherein said centerline is located at the midpoint between a first and second side edge and wherein said plurality of binder rings are located closer to said centerline than to either of said first or second side edge and attached to said binder covers where said plurality of binder rings are offset from on another by a predetermined distance; and e) a hold down page retained by the binder rings, the hold down page having a hold down surface that is configured with a first plurality of article holders and an outer surface opposite the hold down surface that is configured with a second plurality of article holders.

45. The binder arrangement of claim 44 further comprising a hook and loop closure that releasably latches the hold down page to one of the binder covers.

46. A binder arrangement comprising:

a) a pair of covers hingably carried by a single spine and pivotable about a single spine into an opposed orientation;

b) each of said pair of binder covers attached to said single spine by a variable pivot hinge, wherein said binder covers may close into an opposed orientation along a variable pivot axis;

c) wherein said pair of covers and spine are defined by a board that includes a pair of spaced apart integrally formed hinges with each hinge being comprised of a plurality of pairs of scores formed in an interior surface of said board, and wherein each score comprises a slit formed in the interior surface of said board that does not extend completely through said board, and wherein said scores of each hinge define a region of said board that is compressed to a thickness that is less than the surrounding thickness of said board;

d) a plurality of binder rings each hingably carried a predetermined distance from a centerline of a spine wherein said centerline is located at the midpoint between a first and second side edge and wherein said plurality of binder rings are located closer to said centerline than to either of said first or second side edge and attached to said binder covers where said plurality of binder rings are offset from on another by a predetermined distance;

e) a first binder carried by one of the covers that has a first hold down page of multi-function construction; and f) a second binder carried by the other one of the covers that has a second hold down page of multi-function construction.

47. The binder arrangement of claim 46 further comprising a first hook and loop closure that releasably latches the first hold down page to the one of the binder covers and a second hook and loop closure that releasably latches the second hold down page to the other one of the binder covers.

48. A binder arrangement comprising:

a) a pair of covers hingably carried by a spine and pivotable about a single spine into an opposed orientation;

b) each of said pair of binder covers attached to said single spine by a variable pivot hinge, wherein said binder covers may close into an opposed orientation along a variable pivot axis;

c) wherein said pair of covers and spine are defined by a board that includes a pair of spaced apart integrally formed hinges with each hinge being comprised of a plurality of pairs of scores formed in an interior surface of said board, and wherein each score comprises a slit formed in the interior surface of said board that does not extend completely through said board, and wherein said scores of each hinge define a region of said board that is compressed to a thickness that is less than the surrounding thickness of said board;

d) a plurality of binder rings attached to said binder covers where said plurality of binder rings are offset from on another by a predetermined distance;

e) a first binder disposed alongside one of the covers that has a first hold down page with an outer surface configured with an article holder; and f) a second binder disposed alongside the other one of the covers that has a second hold down page with an outer surface configured with an article holder.

49. The binder arrangement of claim 48 further comprising a first hook and loop closure that releasably latches the first hold down page to the one of the binder covers and a second hook and loop closure that releasably latches the second hold down page to the other one of the binder covers.

50. A binder arrangement comprising:

a) a pair of covers hingably carried by a single spine and pivotable about a single spine into an opposed orientation;

b) each of said pair of binder covers attached to said single spine by a variable pivot hinge, wherein said binder covers may close into an opposed orientation along a variable pivot axis;

c) wherein said pair of covers and spine are defined by a board that includes a pair of spaced apart integrally formed hinges with each hinge being comprised of a plurality of pairs of scores formed in an interior surface of said board, and wherein each score comprises a slit formed in the interior surface of said board that does not extend completely through said board, and wherein said scores of each hinge define a region of said board that is compressed to a thickness that is less than the surrounding thickness of said board;

d) a plurality of binder rings each hingably carried a predetermined distance from a centerline of a spine wherein said centerline is located at the midpoint between a first and second side edge and wherein said plurality of binder rings are located closer to said centerline than to either of said first or second side edge and attached to said binder covers where said plurality of binder rings are offset from on another by a predetermined distance;

e) a first binder disposed alongside one of the covers that has a first hold down page that has an outer surface that is configured with a first article holder and a hold down surface opposite the outer surface that is configured with a second article holder; and f) a second binder disposed alongside the other one of the covers that has a second hold down page that has an outer surface that is configured with a first article holder and a hold down surface opposite the outer surface that is configured with a second article holder.

51. The binder arrangement of claim 50 further comprising a first hook and loop closure that releasably latches the first hold down page to the one of the binder covers and a second hook and loop closure that releasably latches the second hold down page to the other one of the binder covers.

* * * * *